US005771586A

United States Patent [19]

Lotarski et al.

[11] Patent Number: 5,771,586

[45] Date of Patent: Jun. 30, 1998

[54] APPARATUS FOR SKIVING BELT ENDS

[75] Inventors: David A. Lotarski, Bolingbrook; Joseph C. Vogrig, Naperville, both of Ill.

[73] Assignee: Flexible Steel Lacing Company, Downers Grove, Ill.

[21] Appl. No.: 467,589

[22] Filed: Jun. 6, 1995

Related U.S. Application Data

[63] Continuation-in-part of Ser. No. 301,696, Sep. 7, 1994, abandoned.

[51] Int. Cl.[6] ..... B26D 3/06; B26D 3/28

[52] U.S. Cl. ..... 30/293; 30/290; 30/294; 83/870; 69/9

[58] Field of Search ..... 83/352, 353, 423, 83/425, 435.1, 436, 633, 640, 856, 857, 858, 870, 874, 875, 745, 734, 614, 426, 428, 382, 488; 30/476, 170, 280, 289, 290, 294, 272.1; 69/13, 9, 11

[56] References Cited

U.S. PATENT DOCUMENTS

| | | | |
|---|---|---|---|
| 158,946 | 1/1875 | King . | |
| 346,651 | 8/1886 | Gross . | |
| 493,351 | 3/1893 | Burbank . | |
| 521,048 | 6/1894 | Ryan . | |
| 641,791 | 1/1900 | Nicolai . | |
| 667,271 | 2/1901 | Webster | 69/11 |
| 810,971 | 1/1906 | Palmer | 69/13 |
| 887,625 | 5/1908 | Grant | 69/13 |
| 1,205,104 | 11/1916 | Nichols | 69/13 |
| 1,217,527 | 2/1917 | Terry | 69/13 |
| 2,040,364 | 5/1936 | Dean . | |
| 2,546,864 | 3/1951 | Mudgway | 69/13 |
| 2,771,103 | 11/1956 | Odlum et al. | 83/438 |
| 3,137,192 | 6/1964 | McNeill | 83/455 |
| 3,324,915 | 6/1967 | Townsend | 69/13 |
| 3,515,019 | 6/1970 | Tyer, Jr. | 83/5 |
| 3,534,646 | 10/1970 | Tyer, Jr. | 83/5 |
| 3,695,713 | 10/1972 | Rothi et al. . | |
| 4,030,394 | 6/1977 | Kistner et al. | 83/409 |
| 4,094,217 | 6/1978 | Exline | 83/6 |
| 4,549,350 | 10/1985 | Patillo | 30/170 |
| 4,656,910 | 4/1987 | Peterson | 83/875 |
| 4,754,678 | 7/1988 | Nichols et al. | 83/875 |
| 5,036,740 | 8/1991 | Tsai | 83/455 |
| 5,065,804 | 11/1991 | Kinuhata et al. . | |
| 5,265,342 | 11/1993 | Lang, Jr. | 30/290 |

FOREIGN PATENT DOCUMENTS

| | | | |
|---|---|---|---|
| 0 240 972 A1 | 10/1987 | European Pat. Off. . | |
| 277591 A2 | 8/1988 | European Pat. Off. | 83/436 |
| 1 153 5140 | 8/1983 | Germany . | |
| 2 038 224 | 7/1904 | United Kingdom . | |
| 366313 | 2/1932 | United Kingdom . | |
| 2 227 703 | 4/1937 | United Kingdom . | |
| 2 009 016 | 6/1979 | United Kingdom . | |
| 2 138 343 | 10/1984 | United Kingdom . | |
| WO 85/00317 | 1/1985 | WIPO . | |

*Primary Examiner*—Eugenia Jones
*Assistant Examiner*—Charles Goodman
*Attorney, Agent, or Firm*—Fitch, Even, Tabin & Flannery

[57] ABSTRACT

A belt skiving apparatus is provided having a free-standing blade-carrying carriage mounting a pair of rollers defining a nip into which a belt end to be skived is passed. The rollers press together about the belt end to securely grip the belt, with at least one of the rollers being driven, preferably manually, through a crank arm. Rotation of the rollers advances the carriage relative to the belt to advance the carriage across the width of the belt. As the carriage is advanced, the belt is passed through the rollers and through a cutting blade disposed adjacent the rollers, with the blade slicing a thin strip of the upper portion of the belt adjacent its upper face from the remainder of the belt. The rollers may be driven by a ratchet arm to move the carriage along the belt end. Preferably, two pairs of rollers are employed on the carriage, one forward and one rearward of the blade to cut the uncut portion remaining at the trailing side of the belt after the belt passes through the forward roller pair. An adjustable fence can be employed for selective variability of the width of the cut from the belt. A quick-acting cam operated by a lever locks the adjustable fence in various positions for different widths of cuts.

18 Claims, 17 Drawing Sheets

Fig. 8
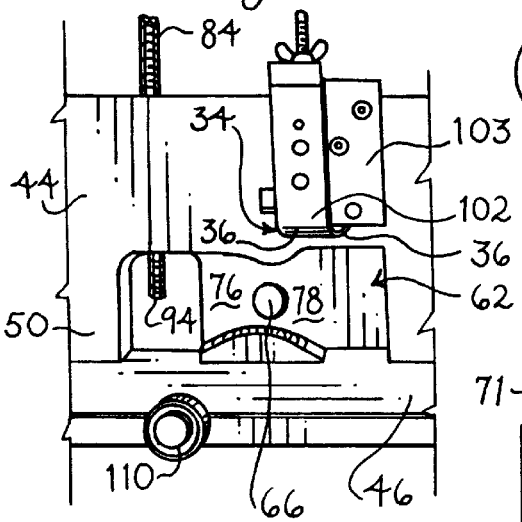
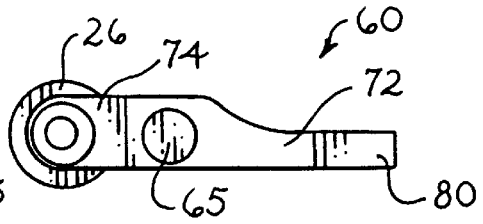
Fig. 4
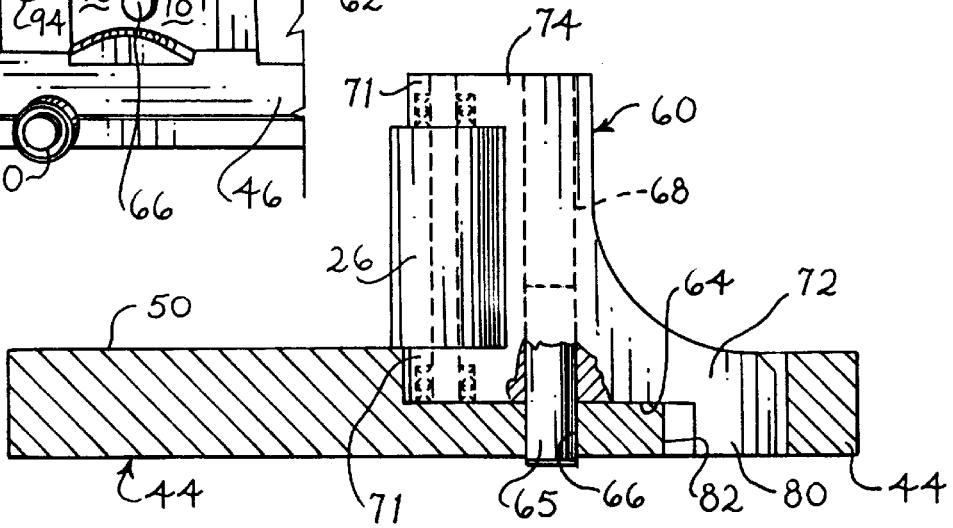
Fig. 5
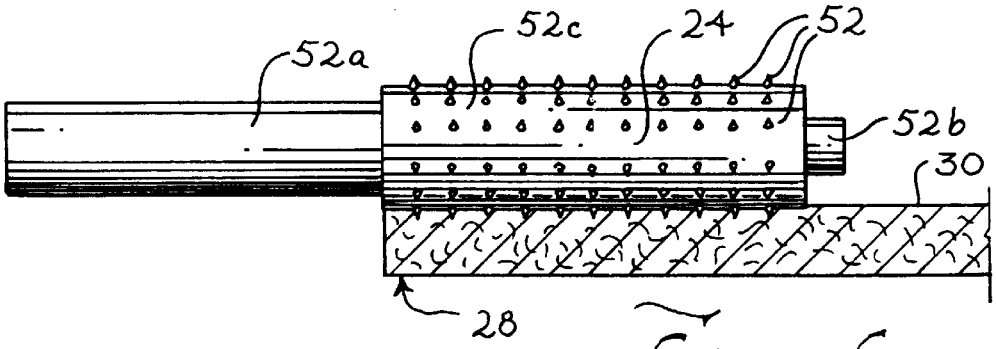
Fig. 6

APPARATUS FOR SKIVING BELT ENDS

CROSS-REFERENCE TO RELATED APPLICATIONS

This is a continuation-in-part of co-pending U.S. patent application Ser. No. 08/301,696, filed on Sep. 7, 1997, now abandoned, which is hereby incorporated by reference as if fully reproduced herein.

FIELD OF THE INVENTION

The present invention pertains to devices for cutting a layer of material from a conveyor belt.

BACKGROUND OF THE INVENTION

Conveyor belt ends are commonly joined together by mechanical fasteners which are fastened to either end of the belt and fastened to one another to connect the belt ends and form a continuous loop. In many applications, it is desirable to skive the belt to form undercuts or grooves in the upper and/or lower surfaces of the belt to receive the mechanical fasteners. Considerable problems have been encountered with currently existing methods and apparatus for skiving belt ends.

U.S. Pat. No. 4,315,450 discloses a device which has performed satisfactorily for skiving belt ends and British patent application 2 227 703A published Aug. 8, 1990 discloses another device proposed for skiving belts. These devices employ a guiding base to which a belt end is clamped, and along which a blade-carrying carriage is guided for reciprocal sliding movement along the base. The base represents a significant portion of the overall cost of these devices and is a large member that often must be transported to the belt location. The base can be both heavy and awkward to carry. Also, with these devices, the belt is required to be securely clamped in stationary position to the base prior to reciprocation of the carriage. The clamping of the belt to the base prior to skiving the belt is time-consuming. There is a need for a skiving apparatus and method which does not require a separate carriage-guiding base or clamping of the belt to a base, and yet produces accurate skiving of belts.

It has been a particular problem to obtain the necessary force to pull a skiving blade through tough fabric, cords, rubber, or other plastic materials in a strong tough conveyor belt. Thus, in the aforementioned U.S. patent there is a base secured to the belt and a winch and cable mounted on the base to exert a pull on the skiving carriage. In the aforementioned British patent, the base is provided with a long rack and the carriage is provided with a pinion gear that meshes with the rack on the base so that turning of the gear causes the carriage to travel forwardly along the base pulling the blade through the belt.

Furthermore, in the prior art devices, the blade carrying carriages experience considerable drag in their sliding movement across the belt when being pulled by a long cable or the like thereby, making manual operation more difficult and time consuming. For instance, the cable of the winch drive of U.S. Pat. No. 4,315,450 pulls the top of the carriage in a downward direction which tends to dig the blade in deeper and to provide a downward component of force on the slidable carriage causing increased resistance to carriage travel along the base. There is a need for a belt skiving device which reduces hang-up and drag of the bladecarrying carriage and provides the force to drive the carriage blade through the belt without a large base for carrying a rack or a winch.

The upper surface of the worn belts are often uneven because of uneven wear the belt has experienced. When a base is clamped to such an uneven surface, it is more difficult to obtain a precise depth of cut and to obtain a substantial uniform depth of cut when skiving such a belt. Thus, there is a need for a device which accurately skives a belt end to produce a predetermined belt thickness at the skived portions of the belt end, regardless of unevenness of the upper surface of a belt due to uneven wear of the upper surface or the like.

SUMMARY OF THE INVENTION

In accordance with the present invention, a belt skiving apparatus and method are provided in which a free-standing blade-carrying carriage is employed, which does not require a guiding base having a rack or a winch thereon to provide the force to cut the tough conveyor belt. This is achieved by driving the blade carrying carriage along the belt with a pair of rollers defining a nip to receive the belt and providing a driving roller mounted on the carriage that will not slip on the belt as the driving roller is turned to propel the carriage across the belt with the skiving blade cutting tough conveyor belt material. The illustrated driving roller is formed with teeth that grip the strip being skived. Rotation of the toothed driving roller advances the carriage relative to the belt to advance the belt through the rollers and through a cutting blade disposed adjacent the rollers, whereby an upper portion of the belt passes above a horizontal portion of the blade, and a lower portion of the belt passes below the horizontal portion of the blade. As the carriage is advanced along the width of the belt by the rollers, the blade slices a narrow strip of the upper portion of the belt adjacent its upper face from the remainder of the belt. The carriage may be mounted on wheels to roll directly on a support surface, without the need for a guiding base. Since no guiding base is required, the skiving apparatus of the present invention may be significantly smaller in size and weight and also less expensive to produce than prior art skiving apparatus requiring a base.

Also, since the belt is gripped directly in the nip of the rollers of the carriage, it is not necessary to clamp the belt end in a stationary position prior to skiving the belt end. This makes skiving carried out with the skiving apparatus of the present invention significantly more simple and less time-consuming than prior art skiving apparatus.

Preferably, the carriage is provided with two sets of rollers which clamp the carriage to the belt and propel the carriage across the belt end with one set of rollers providing the driving force to cut the last portion of the belt after the belt has passed through the nip of the other set of rollers. The rollers may be driven by operation of a ratchet wrench or a power tool to shift the carriage along the belt end.

The width of the cut is adjustable by means of a guide or fence that is adjustably mounted to limit the insertion depth of the belt end into the skiving apparatus. Thus, the guide or fence can be quickly adjusted to a particular position relative to the carriage and locked by a cam and lever device at that position to provide the belt end with a cut of a predetermined width.

Still further, since the lower face of the belt bears firmly against one of the rollers during skiving, the thickness of the belt may be registered or measured from the bottom of the belt, rather than being measured from the upper surface. Hence, the skiving apparatus produces a groove of substantially uniform thickness, regardless of the presence of unevenness in the upper face of the belt prior to skiving.

In addition to overcoming the aforementioned shortcomings associated with prior art skiving apparatus, the skiving apparatus of the present invention lends itself to simple and economical manufacture, and has been found to be easy to use manually in limited space applications such as narrow mines and produce good, substantially uniform grooves.

BRIEF DESCRIPTION OF THE DRAWINGS

In the drawings, wherein like elements are referenced alike:

FIG. 4 is a side elevational view of the pressure roller of the apparatus of FIG. 1;

FIG. 5 is an enlarged, partial top view of the pressure roller showing its pivotal connection to the carriage;

FIG. 6 is an enlarged, partial front elevational view showing the engagement of the driving roller with the belt;

FIG. 8 is partial elevational view of the front side of the vertical wall of the carriage, showing the hourglass-shaped recess in the wall and the aperture through the wall;

DETAILED DESCRIPTION OF THE PREFERRED EMBODIMENTS

Figure 9:
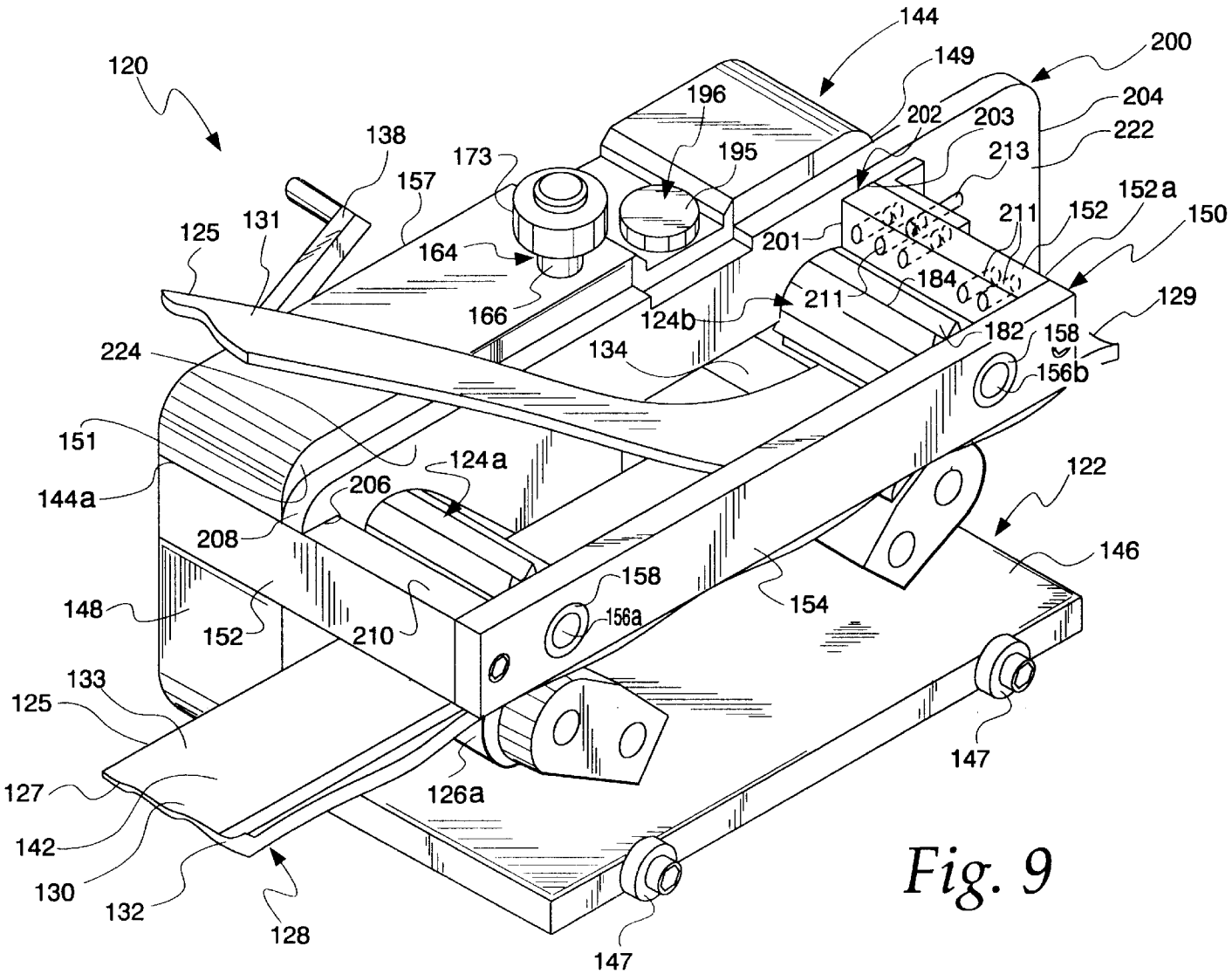
FIG. 9 is a perspective view of preferred embodiment belt skiving apparatus embodying various features of the present invention.
Figure 10:
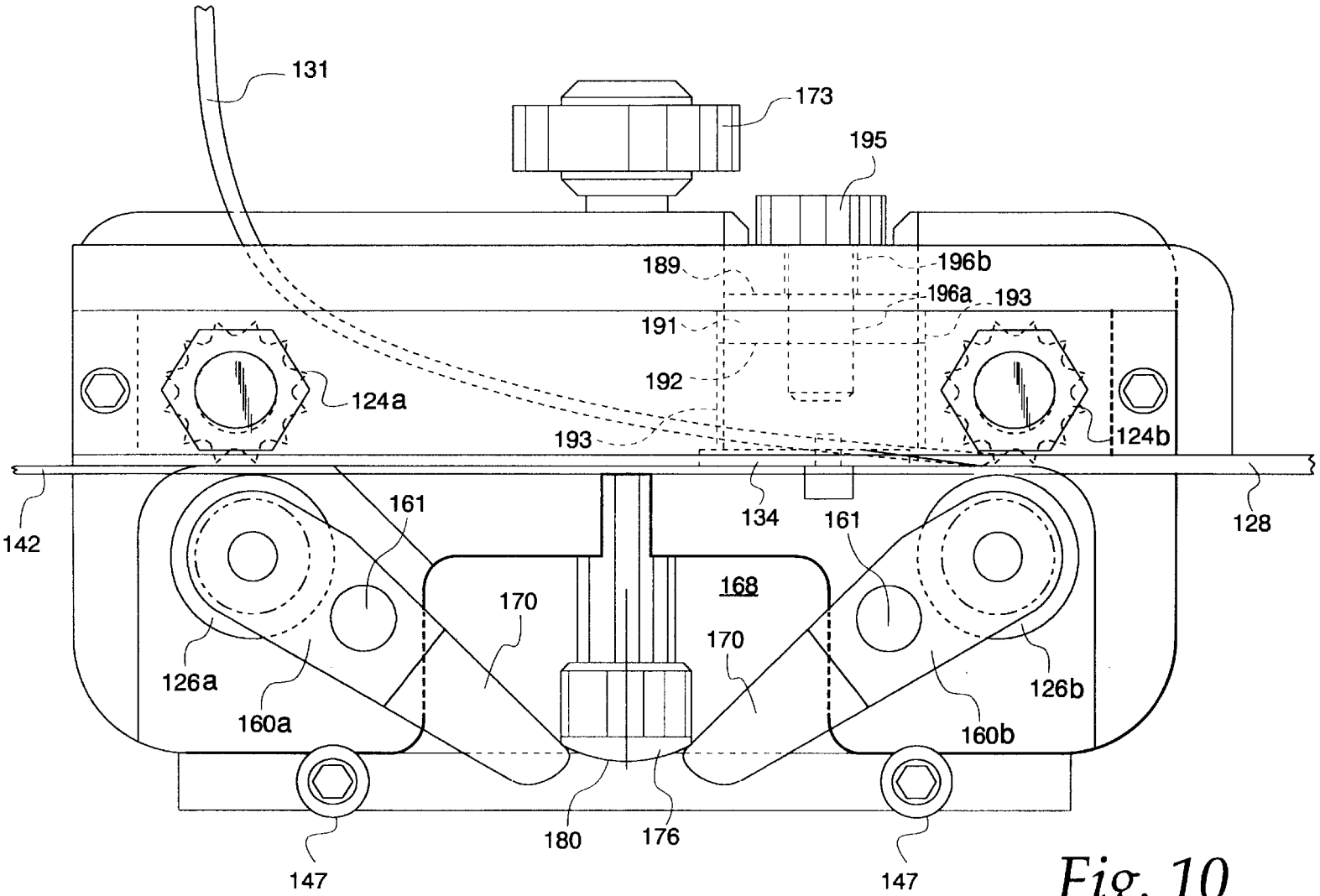
FIG. 10 is a front elevational view of the skiving apparatus of FIG. 9, shown with the pinch rollers in their clamped position.
Figure 11:
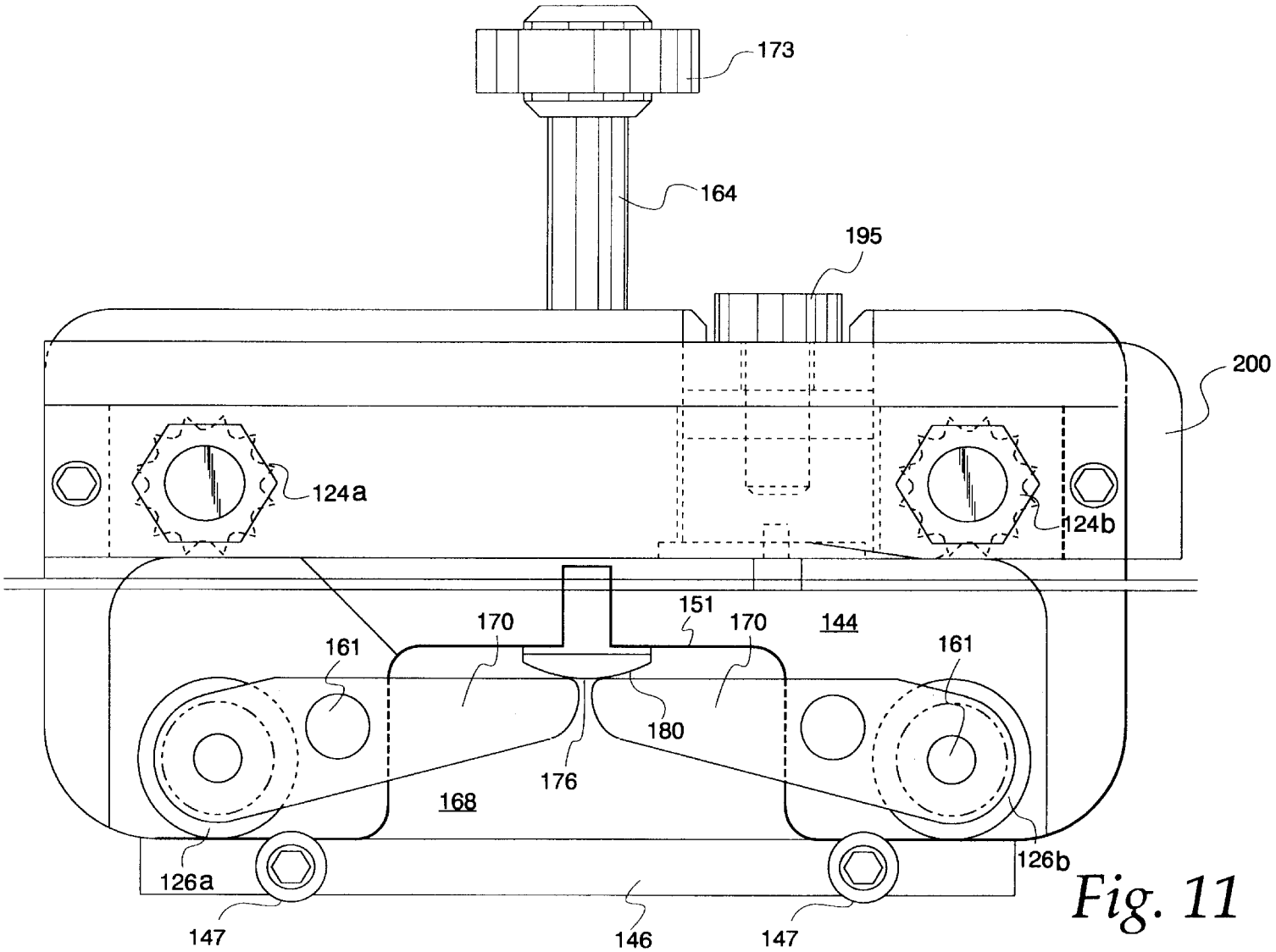
FIG. 11 is a front elevational view of the skiving apparatus of FIG. 9, shown with the pinch rollers in their release position.

As shown in the drawings for purposes of illustration, the invention is embodied in a skiving apparatus 20 that has a carriage 22 carrying a skiving blade 34 for cutting a strip 40 from the belt 28. The carriage may have wheels 110 for rolling across a supporting surface, such as a workbench or conveyor support plate (not shown) and the belt is passed through a nip formed between a pair of rollers 24 and 26. In accordance with the present invention, the force for driving the cutting blade 34 through the belt is from the pair of rollers 24 and 26 at least one of which is provided with a non-slip surface, such as tooth surface, and is driven. As shown in FIG. 6, the first illustrated driving roller 24 has teeth 52 that puncture an upper surface area of the belt, which area is being skived. A lower cost, non-slip surface for the rollers is shown in FIGS. 9–11 where the rollers have an outer corrugated surface formed with parallel, pointed outer elongated teeth 184 between depressions. The rollers shown in FIGS. 9–11 are extruded aluminum or steel rods that are severed into the rollers. The driving roller is located on the carriage closely adjacent the cutting blade and a pinch roller 26 for the driving roller, thereby eliminating the long winch cables or racks on long bases of the prior art skiving devices.

More specifically the driving roller 24 and pressure roller 26 are pressed together against respective upper and lower faces 30 and 32 of the end portion 33 of the belt 28 to clamp the belt therebetween. The skiving blade 34 has a generally horizontal blade portion 36 adjustable to any selective position between the rollers 24 and 26. The driving roller 24 is manually rotatable through a crank arm 38. Rotation of the driving roller 24 advances the carriage 22 relative to the belt 28 to advance the belt 28 through the rollers 24 and 26 and through the cutting blade 34, with an upper strip or portion 40 of the belt 28 passing above the horizontal portion 36 of the blade 34 and a lower portion 42 of the belt 28 passing below the horizontal portion 36 of the blade 34. The blade 34 slices the upper portion 40 of the belt 28, adjacent its upper face 30, from the remainder of the belt 28. As the driving roller 24 is rotated, the carriage 22 is advanced across the width of the belt 28 to advance the blade 34 relative to the belt 28 to skive the belt across its width.

The rollers 24 and 26 engage the belt directly so that no separate base is required as in the prior apparatus. Since the belt is clamped securely by the toothed roller 24 and pinch roller 26 which are disposed adjacent the blade 34, there is little slippage or play of the belt 28 with respect to the blade as the belt is being skived, which allows skiving of thinner upper belt portions than previously attainable while also producing a good, uniform groove in the belt.

Also, the carriage 22 is free-standing, rather than moving within a channel of a base as in the prior art; so that the potential problem of hang-up or sticking of the carriage within the channel is eliminated with the structure of the present invention. Still further, the lower face 32 of the belt 28 bears against the pressure roller 26 during cutting of the belt 28, and the blade 34 is adjustably positionable to a selective distance from the pressure roller 26 to cut the belt to a selective thickness as measured from the lower face 32 of the belt, to overcome variations in thickness associated with wear of the upper face of the belt. Hence, the skiving apparatus of the present invention can cut off an uneven upper face 30 of a belt 28 and produce a groove with the belt having uniform thickness at the groove despite the unevenness of the upper face 30 of the belt 28 at the groove prior to skiving.

Figure 1:
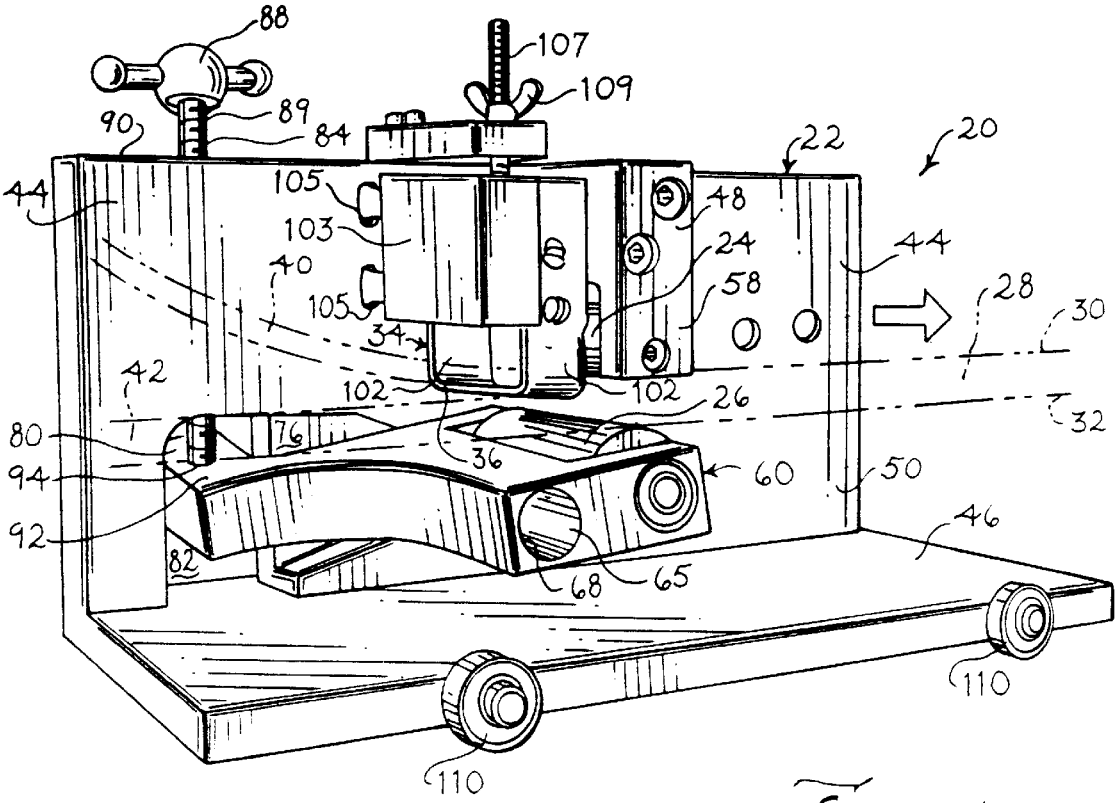
FIG. 1 is a perspective view of a belt skiving apparatus embodying various features of the present invention.
Figure 7:
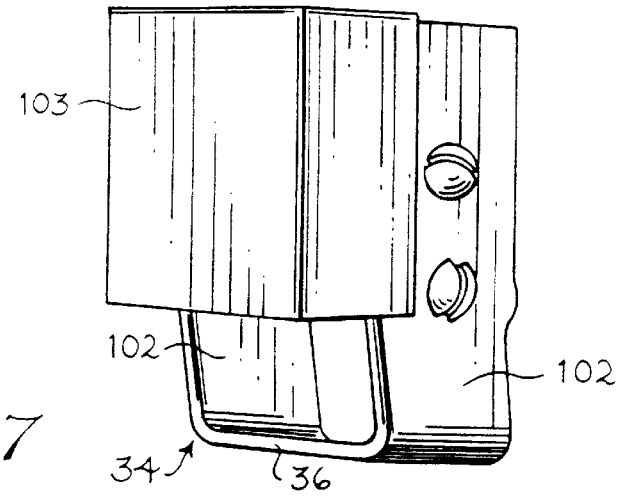
FIG. 7 is an enlarged, perspective view of the cutting blade of the apparatus of FIG. 1.
Figure 3:
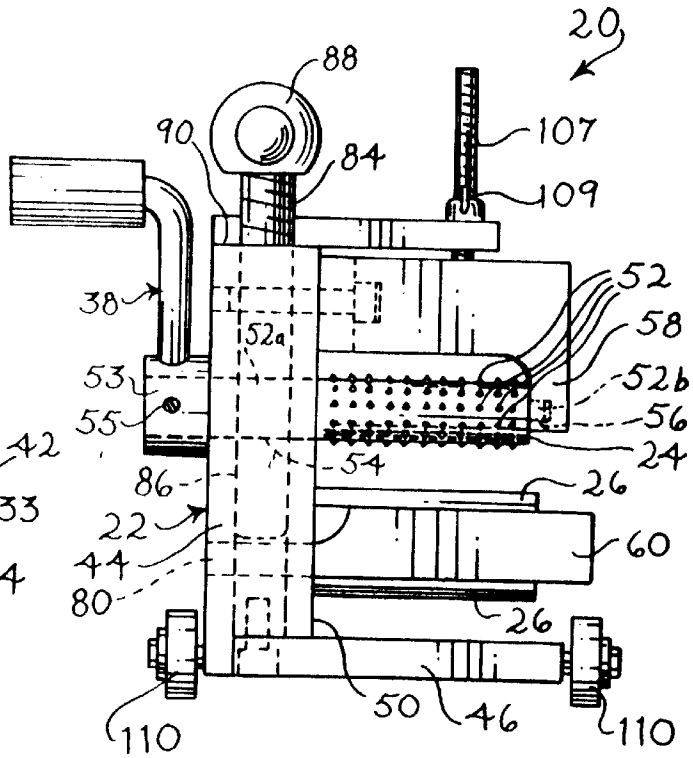
FIG. 3 is a side elevational view of the belt skiving apparatus of FIG. 1.

The illustrated carriage 22 is a generally L-shaped plate which defines integral vertical wall 44 and horizontal wall 46. The carriage 22 may be formed of metal plates, but for reduced manufacturing cost may alternatively be produced of plastic. The driving roller 24 is mounted at a fixed position on the front side 50 of the vertical wall 44. An L-shaped bracket 48 extends from the front side 50 of the vertical wall 44 to rotatably support the driving roller 24 about a fixed rotational axis. As best seen in FIGS. 1 and 3, the driving roller 24 is preferably formed in one piece with stub axles 52*a* and 52*b* (FIG. 6) on opposite ends of a larger diameter center portion 52*c* that has the integral teeth 52 thereon. The stub axles 52*a* and 52*b* are each received in a respective bearings 54 of the vertical wall 44 and a bearing 56 of the L-shaped bracket leg 58 which mounts the roller for rotation about its fixed rotational axis. The axle 52*a* received in the bearing 54 of the vertical wall 44 is an elongated axle which extends completely through the vertical wall and is received in the base 53 of the crank arm 38 and secured by screw 55 for driving rotation of the driving roller 24 as described further below. Alternatively, the elongated axle 52*a* mounts a hex nut which can be received in a socket as in a conventional manually operated ratchet arm or pneumatically powered ratchet arm, as will be more fully described herein.

To accommodate belts of various thicknesses, the pressure roller 26 is disposed on a pivotal bracket 60 to allow selective adjustment of the height of the pressure roller 26 relative to the driving roller 24. By pivoting the bracket 60, the space between the pressure roller 26 and the driving roller 24 may be varied as desired for a given belt thickness, as explained further below.

As best seen in FIGS. 1 and 8, the front side 50 of the vertical wall 44 of the carriage 22 has a generally hourglass-shaped recess 62 formed therein. The pressure roller supporting bracket 60 pivots about a pivot pin 65 which extends into a bore 68 in the bracket 60 and a bore 66 in the vertical wall 44. The portion of the bracket 60 disposed on one side of the pivot pin 65 is an adjusting arm portion 72, and the portion of the bracket 60 disposed on the other side of the pivot pin 65 is a pressure roller supporting portion 74 having a U-shape with the pressure roller 26 supported on either end by legs 71 of the U-shaped portion 74.

The inner side 64 of the respective portions 72 and 74 of the pivotal bracket 60 are disposed in respective portions 76 and 78 of the recess 62 for oscillatory pivotal movement of the inner sides of the bracket portions 72 and 74 within respective recess portions 76 and 78. In the illustrated embodiment, the pressure roller 26 is disposed generally beneath the driving roller 24, and pivotal movement of the bracket 60 varies the distance between the driving roller 24 and the pressure roller 26 to accommodate belts of different thickness. To adjust the position of the pressure roller 26 with respect to the driving roller 24, the adjusting arm portion 72 of the bracket 60 has a short leg 80 which extends generally perpendicularly with respect to the inner side 64 of the bracket 60, and extends into an aperture 82 in the vertical wall 44 (see FIGS. 1 and 5). A threaded pivotal bracket adjusting member 84 is threadably received within a threaded bore 86, which extends generally vertically and parallel to the front side 50 of the vertical wall 44. The upper end 89 of the threaded pressure roller adjusting member 84 extends upwardly from the upper end 90 of the vertical wall 44, and the lower end 94 of the threaded member 84 extends down into the aperture 82 in the vertical wall 44 and bears against the upper side 92 of the leg 80 of the adjusting arm 72.

Figure 2:
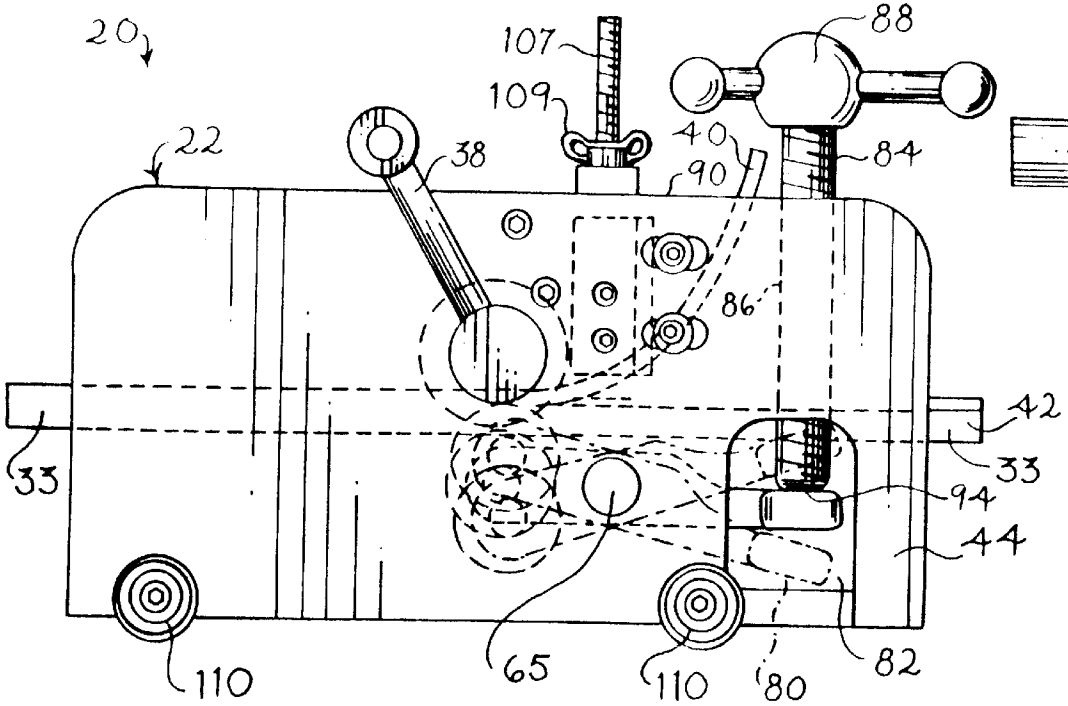
FIG. 2 is a rear elevational view of the belt skiving apparatus of FIG. 1.

Accordingly, adjustment of the nip between the pressure roller 26 and the driving roller 24 and the pressure needed for the teeth 52 to puncture the belt is obtained for a given belt thickness by simple manual rotation of the handle 88 provided at the upper end 89 of the threaded adjusting member 84. Rotation of the handle 88 rotates the threaded adjusting member 84, which moves the lower end of the threaded member 84 vertically. Hence, clockwise rotation of the handle 88 moves the lower end 94 of the threaded member 84 downwardly to force the adjusting arm portion 72 of the bracket 60 downwardly, which in turn pivots the bracket 60 about pivot pin 65 to raise the pressure roller 26 upwardly and narrow the space between the pressure roller 26 and the driving roller 24. Similarly, counter-clockwise rotation of the handle 88 moves the lower end 94 of the threaded member 84 upwardly to allow the adjusting arm portion 72 of the bracket 60 to move upwardly, which in turn pivots the bracket 60 about pivot pin 65 to lower the pressure roller 26 downwardly, and enlarge the space between the pressure roller 26 and the driving roller 24. FIG. 2 illustrates the variable positioning of the pressure roller.

In practice, the handle 88 may be rotated counter-clockwise so that the space between the rollers 24 and 26 is greater than the thickness of the belt 28 to be skived. A leading end of the belt 28 is inserted between the rollers 24 and 26 and held in place as the handle 88 is rotated clockwise to raise the pressure roller 26 upwardly into abutment with the lower face 32 of the belt 28. The handle 88 is then rotated clockwise further, to securely clamp the belt 28 between the rollers 24 and 26 and to cause the teeth 52 to puncture the belt strip to be severed. With the belt 28 firmly engaged between the rollers 24 and 26, rotation of the driving roller 24 advances the belt 28 through the rollers 24 and 26, as described further below.

The cutting blade 34 is preferably disposed directly adjacent the rollers 24 and 26 to slice off a layer of the belt 28 adjacent its upper face 30, as the rollers 24 and 26 grip and advance the blade 34 across the width of the belt 28. Unlike the aforementioned prior art skiving apparatus in which the belt is either clamped to a base at its edges prior to skiving or nailed to a base across its entire width prior to skiving, the belt skiving apparatus of the present invention does not require such time-consuming clamping preparations prior to carrying out skiving of the belt, as the same rollers 24 and 26 which drive the carriage 22 across the belt 28 also clamp the belt securely during cutting. That is, the rollers 24 and 26 clamp the belt securely directly adjacent the blade 34 during skiving. The rollers 24 and 26 maintain clamping engagement of the belt 28 directly adjacent the blade 34 throughout advancement of the carriage 22 across the width of the belt 28 so that the belt is gripped securely by the rollers 24 and 26 directly adjacent the blade 34 throughout skiving of the belt by the blade 34. This has been found to provide significantly improved accuracy in the grooves formed by skiving, which allows thinner upper layers to be accurately removed than previously obtainable.

The illustrated blade 34 is U-shaped having a central, generally horizontal blade portion 36 and two spaced vertical blade portions 102 extending upwardly at and from opposite ends of the central horizontal blade portion 36. Other shapes of blades, such as a horizontal blade, may be used instead of the U-shaped blade. The forward edges of the horizontal and vertical blade portions 36 and 102 are sharp cutting edges. The vertical blade portions 102 fit in recesses in opposite faces of a blade holding block 103 and are secured to the blade holding block 103 by spaced bolts being threaded into the block through openings in the blade. The block 103 is supported in turn by bolts threaded into taps in the block and protruding through slots 105 in the vertical wall 44 of the carriage 22. Upon tightening the bolts against the slides, the block can be held with the horizontal blade portion 36 at any adjusted depth below the upper face 30 of the belt so as to cut away the upper portion 40 of the belt 28 and form the desired groove adjacent the belt end. To assist in holding the block while the bolts are being tightened, a holding screw 107 may be employed with its lower end threaded into the top of the holding block 103. The block may be held in place with one hand by wing nut 109 while the operator tightens the bolts to secure the blade with the other hand.

As discussed above, the driving roller 24 is operatively coupled to the base 53 of the crank arm 38 through axle 52*a*. Hence, the driving roller 24 may be rotated by the operator manually gripping the handle 88 of the crank arm 38 and rotating the crank arm 38. Manifestly, rather than a direct connection between the driving roller 24 and the crank arm 38, the crank arm 38 may be operatively connected to the driving roller 24 through gears to obtain a mechanical advantage. However, it has been found that the force required to advance the belt 28 through the blade 34 to skive the belt, with the structure of the belt skiving apparatus of the present invention, is sufficiently small that no gears are required. Also, a motor may be employed to drive the drive roller, however, due to the extra space which external drives require and the added production cost, external drives are not desired. Hence, to minimize production costs, no gears or external, automated roller driving equipment are employed in the illustrated embodiment of the invention. Nevertheless, as previously mentioned, it is possible to use a manually operated ratchet arm or a pneumatically powered ratchet arm in place of the crank arm 38 to drive the drive roller without the additional space and expense as required with external drives as described above.

The driving roller 24 preferably has a non-slip surface, preferably such as short spikes or teeth 52 extending about its periphery. As best illustrated in FIG. 6, the spikes 52 dig into the upper face 30 of the belt 28 when the belt 28 is clamped between the rollers 24 and 26 to securely grip the belt and prevent slippage of the belt with respect to the driving roller 24. Hence, upon rotation of the crank arm 38, the drive roller 24 rotates and its teeth 52 dig into and grip the upper face 30 of the belt as the drive roller rotates, to securely grip the belt and advance the belt with respect to the blade 34. Other alternatives to teeth may be roughened surfaces or the like to prevent slippage of the drive roller 24 on the belt surface as the drive roller is turned.

It is important, in order to produce a uniform groove in the belt with the skiving apparatus 20 of the present invention, that the end of the belt being skived be maintained flush against the front side 50 of the vertical wall 44 throughout advancement of the carriage 22 along the width of the belt, and not migrate away from the front side 50 of the vertical wall 44 as the carriage is driven across the width of the belt. This may be carried out in any of several ways. For instance, additional rollers may be provided to guide and hold the belt directly adjacent the front side 50. Alternatively, the rollers 24 and 26 may be tapered in the direction of the vertical wall 44 to urge the belt 28 in the direction of the vertical wall 44.

Also, to allow for variability of the width of the groove cut into the belt means may be provided for adjusting the position of the front side 50 of the vertical wall 44 and/or the spacing of the blade 34 from the vertical wall. For instance, an adjustable thin plate may be provided adjacent and generally parallel to the vertical wall 44. The plate may be moved toward and away from the vertical wall 44 to allow selective variability of the width of the groove from the end 33 of the belt 28. The position of the blade 34 may also be adjustable for variation of the width of the groove formed in the belt, with the blade being movable closer to the front side 50 of the vertical wall 44 for formation of thinner grooves and movable further from the front side 50 of the vertical wall 44 for formation of wide grooves.

In carrying out skiving of a conveyor belt in accordance with the present invention, an end portion of a belt is passed between a pair of rollers which clamp about the belt. One of the rollers is a driving roller which is rotated to advance the blade-carrying carriage with respect to the belt across its width. The illustrated carriage has rollers which roll across the width of the belt as the belt is advanced through the rollers. The illustrated carriage has wheels, but the carriage may be constructed without any wheels. A cutting blade is disposed adjacent the rollers, and positioned such that the rollers force an upper portion of the belt above the blade and a lower portion of the belt below the blade. The forward edge of the blade thus slices off the upper part of the belt from the remainder of the belt as the carriage is advanced along the width of the belt.

While the skiving apparatus 20 described above has generally been found to be well-suited for skiving a belt, it was found that the skiving apparatus 20 did not always drive the blade past the final, trailing end portion of the belt, leaving a small end portion of approximately 3/16 inch of the belt uncut. That is, with the skiving apparatus 20 near the completion of skiving a belt across its width from a leading side of the belt to a trailing side of the belt, the trailing side of the belt passes through, and out of engagement with the driving roller 24 prior to reaching the cutting blade 34. Therefore, there is no driving of the final trailing side portion of the belt past the blade, and the short portion at the trailing side of the belt remains uncut, requiring a separate operation to manually cut the final trailing end portion of the belt. There is a need for a belt skiving apparatus which cuts a strip from a belt along the entire width of the belt adjacent at its end, from its leading side completely to its trailing side.

Also, with the belt driven by the toothed roller 24 having generally uniformly distributed teeth about its periphery as discussed above, the belt 28 may migrate away from the front side 50 of the vertical wall 44 and may become angled with respect the front side 50 of the vertical wall 44. This may result in unevenness in the width of the strip cut from the belt. Additionally, the production of the toothed roller 24 is relatively expensive Accordingly there is a need for an arrangement for driving the belt which prevents the belt from becoming askew as it is advanced with respect to the cutting blade to assure accurate skiving of the belt. It is also desirable to provide such an arrangement in which the driving roller may be produced less expensively than the toothed roller discussed above.

A preferred embodiment of a skiving apparatus which satisfies the above objectives is illustrated in FIGS. 9–13, and referred to generally by reference numeral 120. As with the skiving apparatus 20 discussed above, the preferred skiving apparatus 120 has a free-standing carriage 122. The carriage 122 is a generally L-shaped member which defines an integral vertical wall 144 and horizontal wall 146. The carriage may have wheels 147 for rolling across a supporting surface such as a workbench or conveyor support plate.

The carriage 122 of the preferred embodiment carries a J-shaped skiving blade 134 for cutting a strip from the end 125 of a belt 128, as discussed further below. The portion of the belt 128 adjacent its end 125 is passed through a pair of nips defined by respective pairs of rear and forward driving and pressure rollers 124*a* and 126*a*, and 124*b* and 126*b*, with a forward nip defined by the forward driving and pressure rollers 124*b* and 126b disposed closely ahead of the blade 134 and a rear nip defined by the rear driving and pressure rollers 124*a* and 126*a* disposed rearward of the blade 134. The rear and forward driving rollers 124*a* and 124*b* and respective rear and forward pressure rollers 126*a* and 126*b*, which together define the aforementioned forward and rear nips, are pressed against respective upper and lower faces 130 and 132 of the end portion 133 of the belt 128 which is to be skived to securely clamp the belt between the respective driving and pressure rollers at both the forward and rear nips. Hence, with the belt 128 securely clamped between both the forward and rear pairs of driving and pressure rollers, the carriage may be driven relative to the belt at two separate locations, one forward and one rearward of the blade 134, upon rotation of the drive rollers 124*a* and 124*b*. Therefore, during a skiving operation, after an upper strip 131 has been sliced from the belt 128 from its leading side 127 to near its trailing side 129, and the trailing side 129 of the belt passes between the forward driving roller 124*b* and forward pressure roller 126*b* and out of engagement therewith, the belt continues to be pulled forward by the rear driving roller 124*a* and rear pressure roller 126*a* to pull the trailing side 129 of the belt 128 past the blade 134 to cut the final part of the strip 131 at the trailing side 129 of the belt 128.

Figure 12:
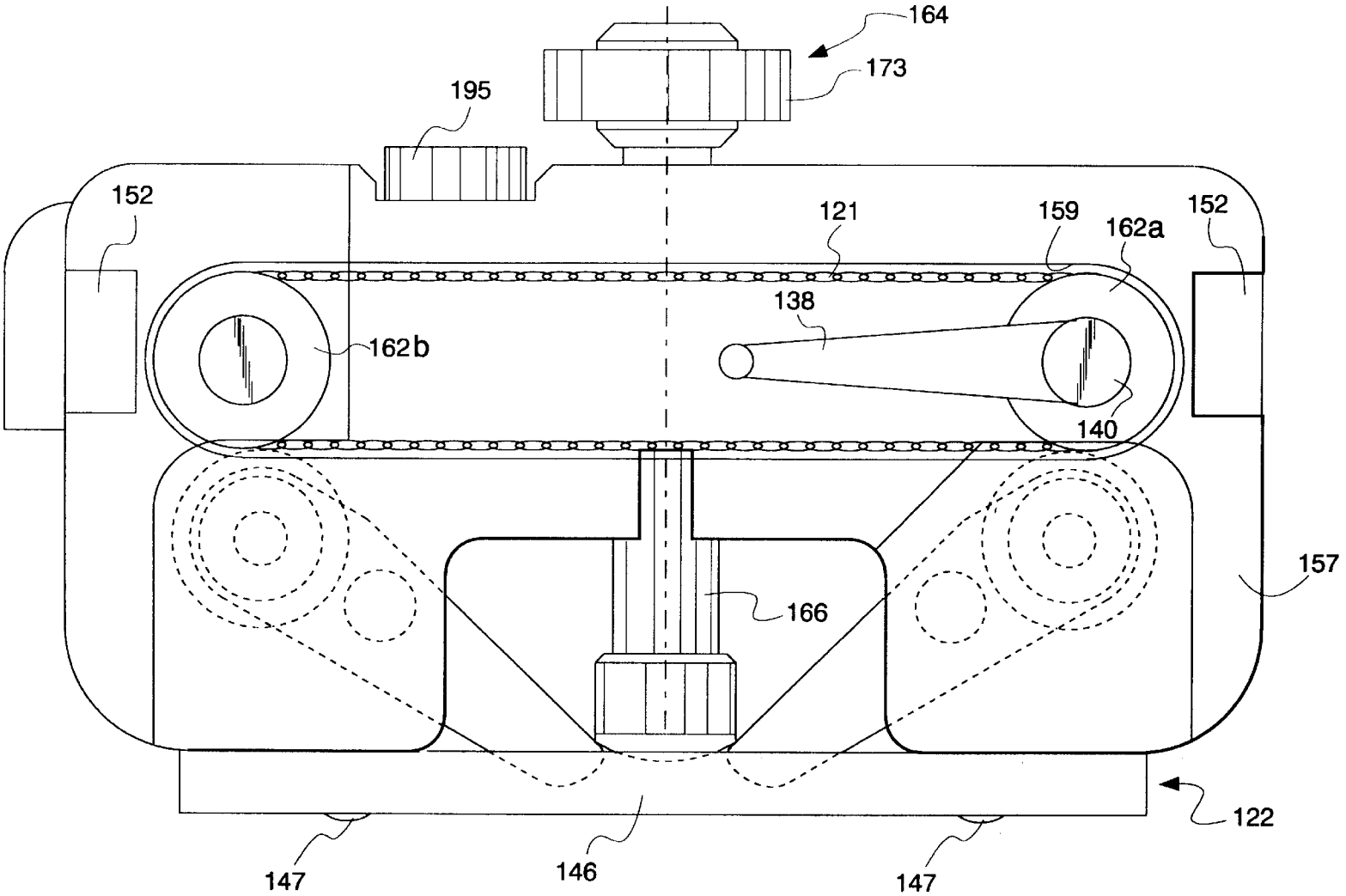
FIG. 12 is a rear elevational view of the skiving apparatus of FIG. 9, shown with the pinch rollers in their clamping position.

To drive the rear and forward driving rollers 124*a* and 124*b* together, the driving rollers 124*a* and 124*b* are preferably interconnected by a chain 121 (FIG. 12). Herein, the rear and forward driving rollers 124*a* and 124*b* rotate together by manually rotating a crank arm 138 attached to one of the drive rollers 124, preferably the rear drive roller 124*a*. Rotation of the crank arm 138, or operation of the previously mentioned ratchet arm to be more fully described herein, causes both the forward and rear pair of rollers to advance the carriage 122 and the cutting blade 134 mounted to the carriage 122 relative to the belt 128, with an upper strip or portion 131 of the belt 128 passing above the blade 134 and a lower portion 142 of the belt 128 passing below the blade 134, to slice away an upper strip 131 of the belt 28 from the leading side 127 of the belt 128 to the trailing side 129 of the belt. After the trailing side 129 of the belt 128 has been passed through the forward driving roller 124*b* and forward pressure roller 126*b*, continued rotation of the crank arm 138 effects continued rotation of the rear drive roller 124*a* for continued driving of the carriage relative to the belt 128 to drive the blade 134 past the trailing side 129 of the belt. The interconnection of the drive rollers 124*a* and 124*b* eliminates the necessity of removing the crank arm 138 from one of the drive rollers and reattaching it to the other drive roller to carry out the final cut of the strip 131 from the belt.

The pair of nips forward and rearward of the blade 134 overcome several shortcomings associated with a single drive roller and pressure roller. As discussed above, a single drive roller and pressure roller rearward of the blade 134 does not drive the final trailing side of the belt past the blade. A single drive roller and pressure roller forward of the blade 134, while being suitable for pulling the entire trailing side of the belt past the blade, would make it difficult to initiate the skive at the leading side 127 of the belt. Additionally, as discussed above, the provision of a nip closely adjacent the blade 134 provides accuracy in skiving operations which is not attainable with nips spaced further from the blade.

The combination of a first nip defined by a forward driving roller 124*b* and pressure roller 126*b* closely adjacent and forward of the blade 134 and a second nip defined by a rear driving roller 124*a* and rear pressure roller 126*a* provides accurate skiving over the entire width of the belt 128, from its leading side 127 to its trailing side 129. Specifically, the forward nip defined by the forward driving roller 124*b* and forward pressure roller 126*b* engages the leading side 127 of the belt 128 initially and advances the belt past the blade 134 from the leading side 127 of the belt 128 toward its trailing side 129. The forward driving roller 124*b* and pressure roller 126*b* advance the leading side 127 of the belt 128 into the rear nip defined by the rear driving roller 124*a* and rear pressure roller 126*a*, whereupon both the forward and rear pairs of rollers drive the belt together. The rear and forward driving rollers 124*a* and 124*b* continue to drive the belt together until the trailing side 129 of the belt 128 passes through the forward driving roller 124*b* and pressure roller 126*b*, and out of engagement therewith. Thereafter, the rear driving roller 124*a* continues to drive the belt 128 to pull the small uncut portion of the strip 131 at the trailing side of the belt past the blade 134 to effect the final cutting of the strip 131 from the belt 128. Since the forward nip defined by the forward drive roller 124*b* and forward pressure roller 126*b* is situated in close proximity to the blade 134, the end portion of the strip 131 remaining uncut at the trailing side 129 of the belt after the trailing side of the belt passes between the forward drive roller 124*b* and forward pressure roller 126*b* is small.

In the illustrated embodiment, the rear and forward driving rollers 124*a* and 124*b* are supported by a supporting bracket 150 (FIGS. 9 and 16) which extends generally horizontally forward of the vertical wall 144. In the illustrated embodiment, the vertical wall 144 is provided with respective channels 144*a* in its rear and forward ends 148 and 149 for receiving respective legs 152 of the supporting bracket 150. The legs 152 are secured in their respective channels 144*a* to support the roller engaging bar portion 154 of the supporting bracket 150 horizontally and in spaced relation from the vertical wall 144, as illustrated in FIG. 9.

The drive rollers 124*a* and 124*b* have respective stub axles 156*a* and 156*b*. The stub axles 156*a* and 156*b* of the drive rollers 124*a* and 124*b* are each received in respective bearings (not shown) of the vertical wall 144 and bearings 158 of the roller engaging bar portion 154 of the supporting bracket 150 which mounts the drive rollers 124*a* and 124*b* for rotation about their respective fixed rotational axes. The stub axle 156*a* of the rear drive roller 124*a* received in the bearings of the vertical wall 144 is an elongated axle which extends through the vertical wall 144. The portion of the elongated axle 156*a* of the rear drive roller 124*a* which extends through the vertical wall 144 of the carriage is receivable in the base 140 of a crank arm 138 for driving rotation of the rear drive roller 124*a*. The axles 156*a* and 156*b* of the rear and forward drive rollers 124*a* and 124*b* have respective sprocket wheels 162*a* and 162*b*, preferably of substantially equal diameter to one another, which are interconnected by the chain 121 to drive both the rear and forward drive rollers 124*a* and 124*b* simultaneously. As previously stated, manual rotation of the crank arm 138 rotates both of the drive rollers 124*a* and 124*b* simultaneously.

Figure 18:
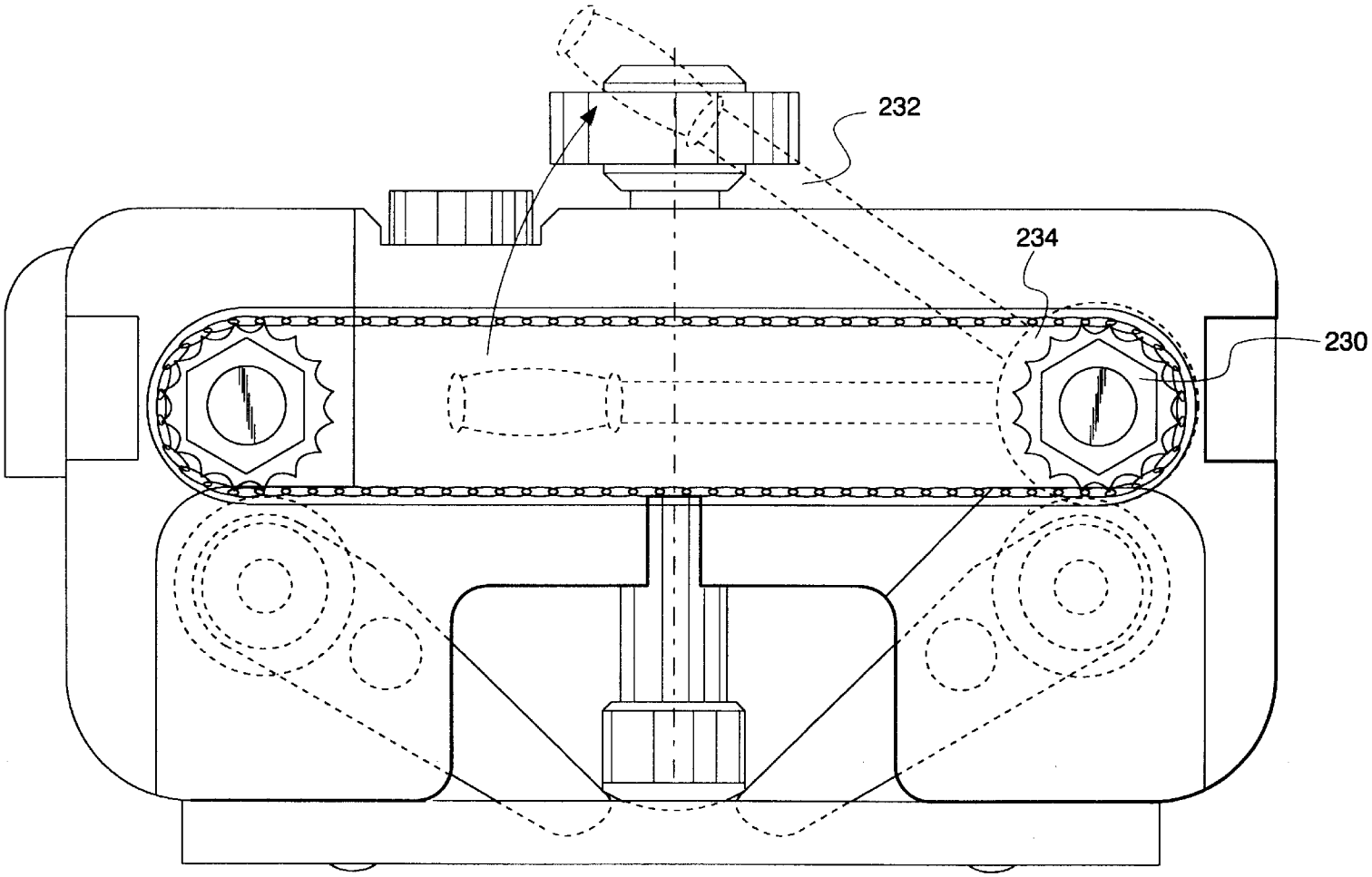
FIG. 18 is a rear elevational view of the skiving apparatus of FIG. 9, showing a manually driven ratchet arm connected to a drive roller.
Figure 19:
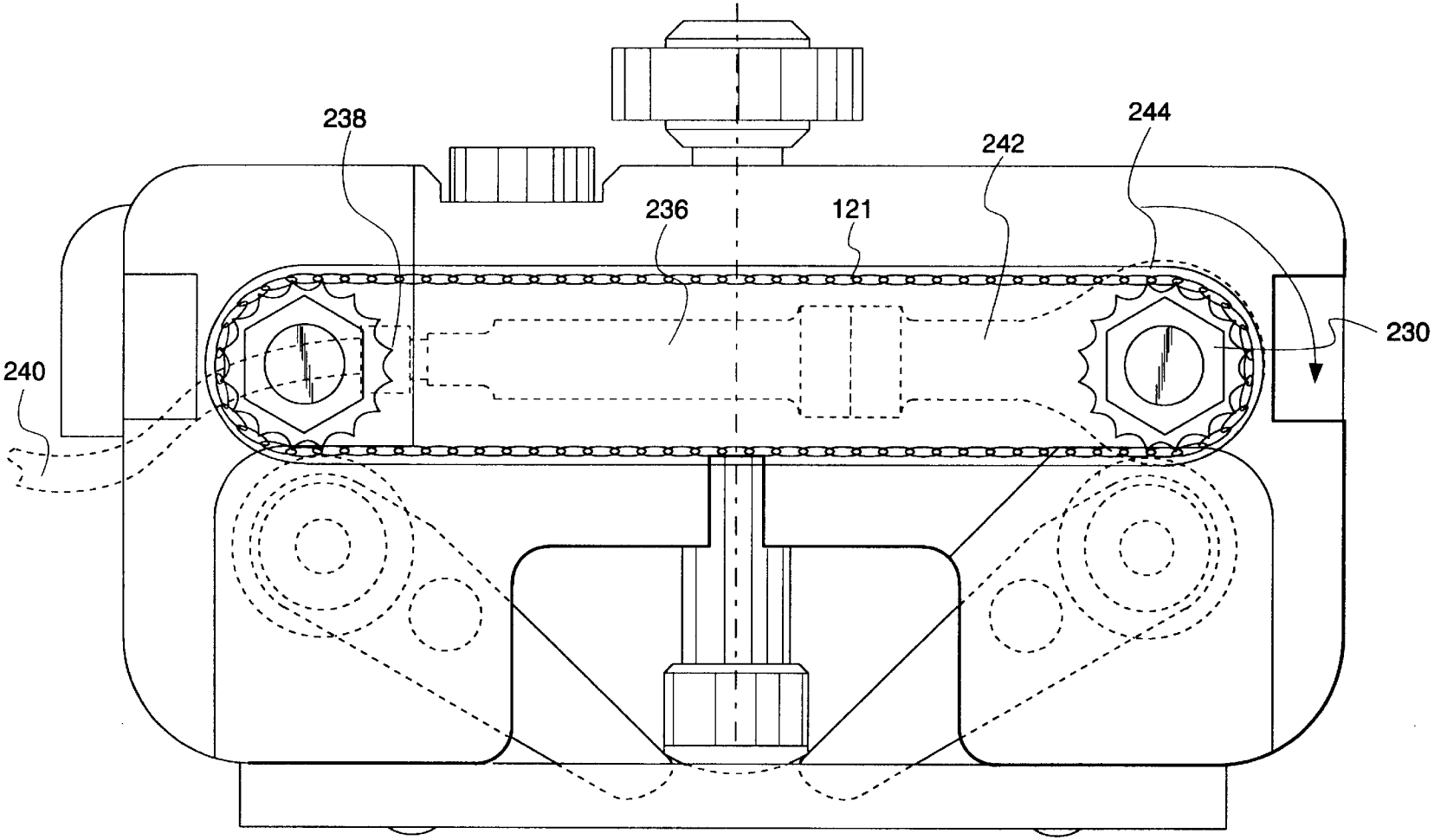
FIG. 19 is a rear elevational view of the skiving apparatus of FIG. 9, showing a pneumatically powered ratchet arm connected to the roller.
Figure 20:
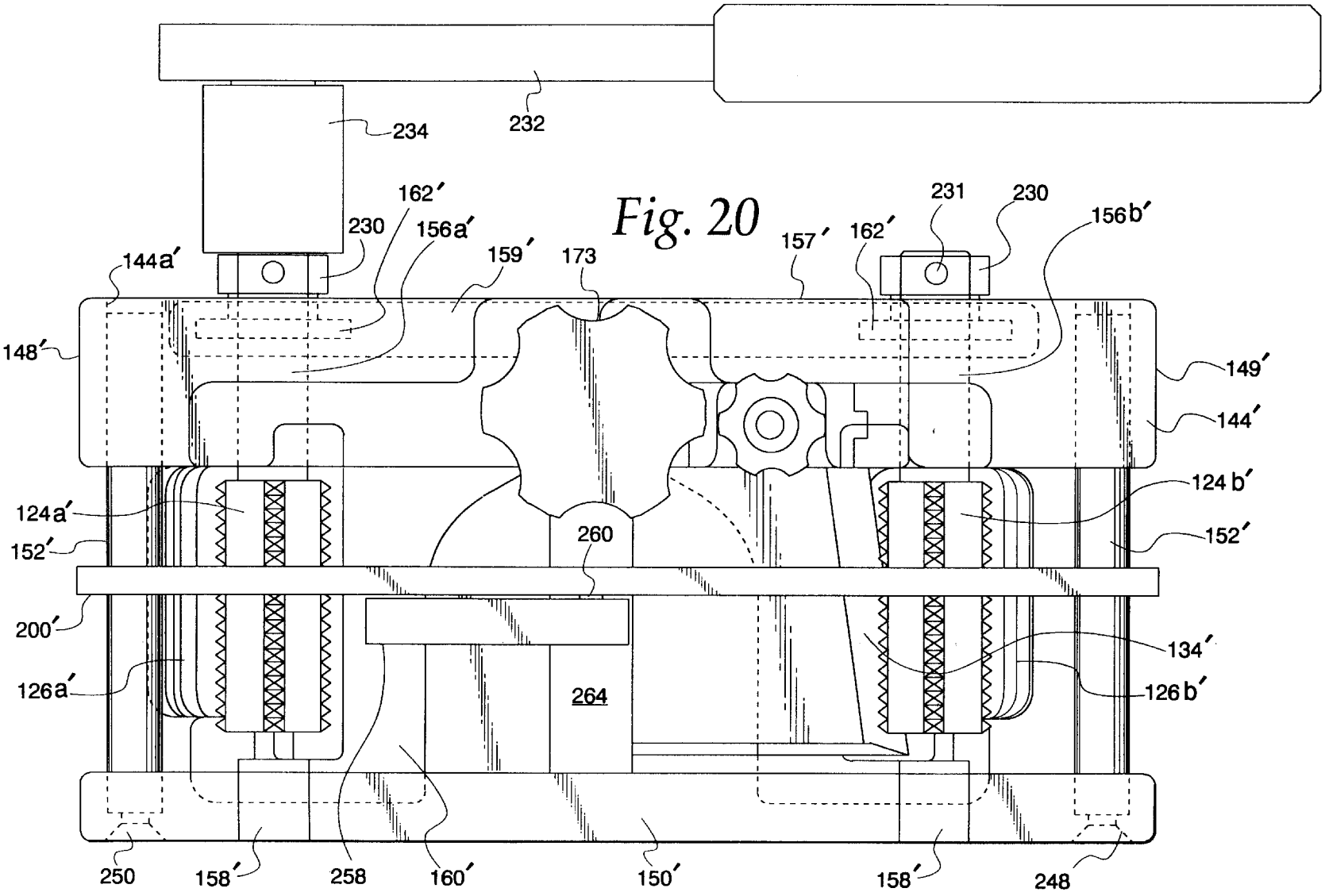
FIG. 20 is a top plan view of the body of a slightly modified version of the skiving apparatus of FIG. 9, including a fence cam-locking mechanism.

Alternatively, the portion of the elongated axle 156*a* of the rear drive roller 124*a* which extends through the vertical wall 144 of the carriage mounts a hex nut 230, as seen in FIGS. 18 and 19. By mounting the hex nut 230 to the portion of the elongated axle extending through the vertical wall, a conventional ratchet arm 232 and socket 234 can be employed to drive the drive roller 124*a*. Referring to FIG. 18, the ratchet arm 232 can be cranked and ratcheted to rotate the socket 234 and hex nut 230 received therein to thereby rotatably drive the drive roller 124*a*. Similarly, as seen in FIG. 19, a pneumatic or other power actuated tool 236 can be utilized. The tool 236 is connected at one end 238 to an air supply line 240 and at the other end 242 to a socket 244 adapted to receive the hex nut 230 therein. Thus, operation of the pneumatically driven ratchet tool 236 rotates the socket 244 and hex nut 230 to drive the rollers and propel the carriage along the belt ends.

Figure 13:
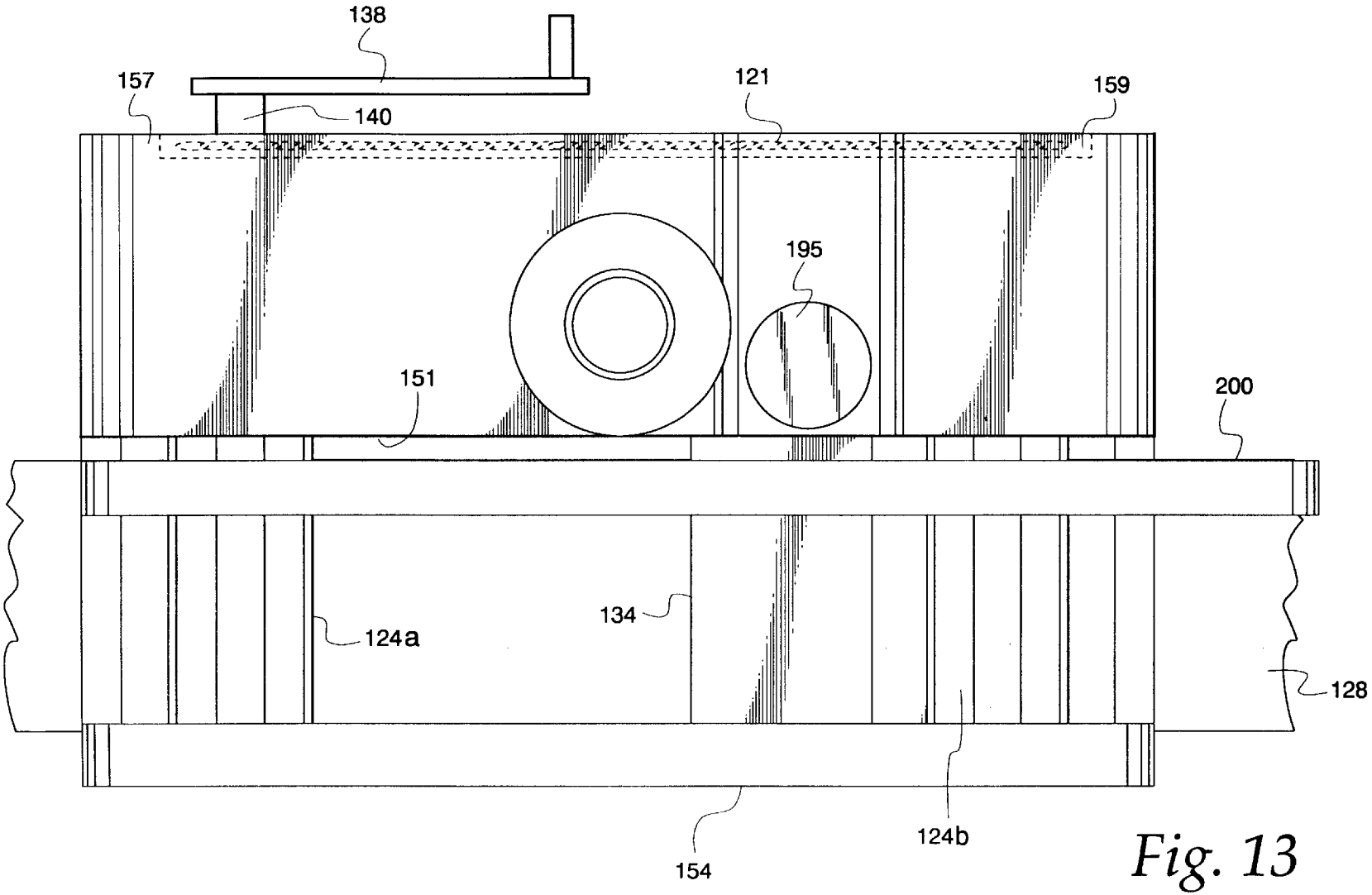
FIG. 13 is a top elevational view of the skiving apparatus of FIG. 9.

With reference to FIG. 13, in the illustrated embodiment, the vertical wall 144 has a centralized recess 159 adjacent its rear face 157. The sprocket wheels 162 and chain 121 are disposed in the recess 159 of the vertical wall 144, so that the vertical wall 144 shields the sprocket wheels 162 and chain 121.

Figure 14:
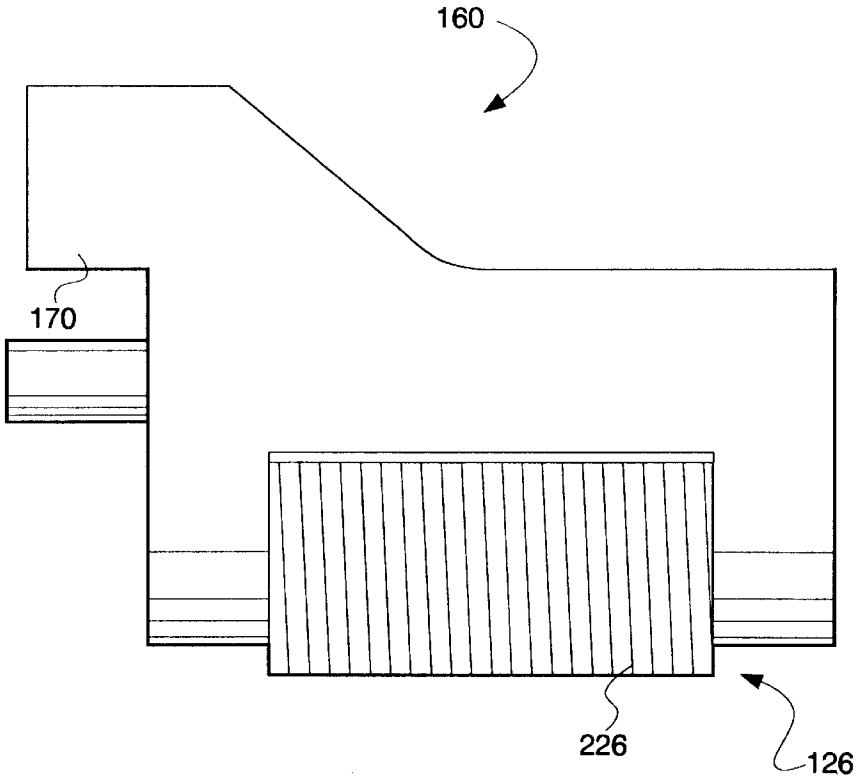
FIG. 14 is an enlarged top elevational view of the pivotal bracket in the skiving apparatus of FIG. 9.

As with the skiving apparatus 20 discussed above, the gap between the pressure rollers 126*a* and 126*b* and their respective driving rollers 124*a* and 124*b* is variable to accommodate belts 128 of various thicknesses. To this end, the pressure rollers 126*a* and 126*b* are disposed on respective pivotal brackets 160 (see FIG. 14), which are, in turn, mounted on respective pivot pins 161 extending horizontally forward from the vertical wall 144, to allow selective adjustment of the height of the pressure rollers 126*a* and 126*b* relative to their respective driving rollers 124*a* and 124*b* .

Figure 16:
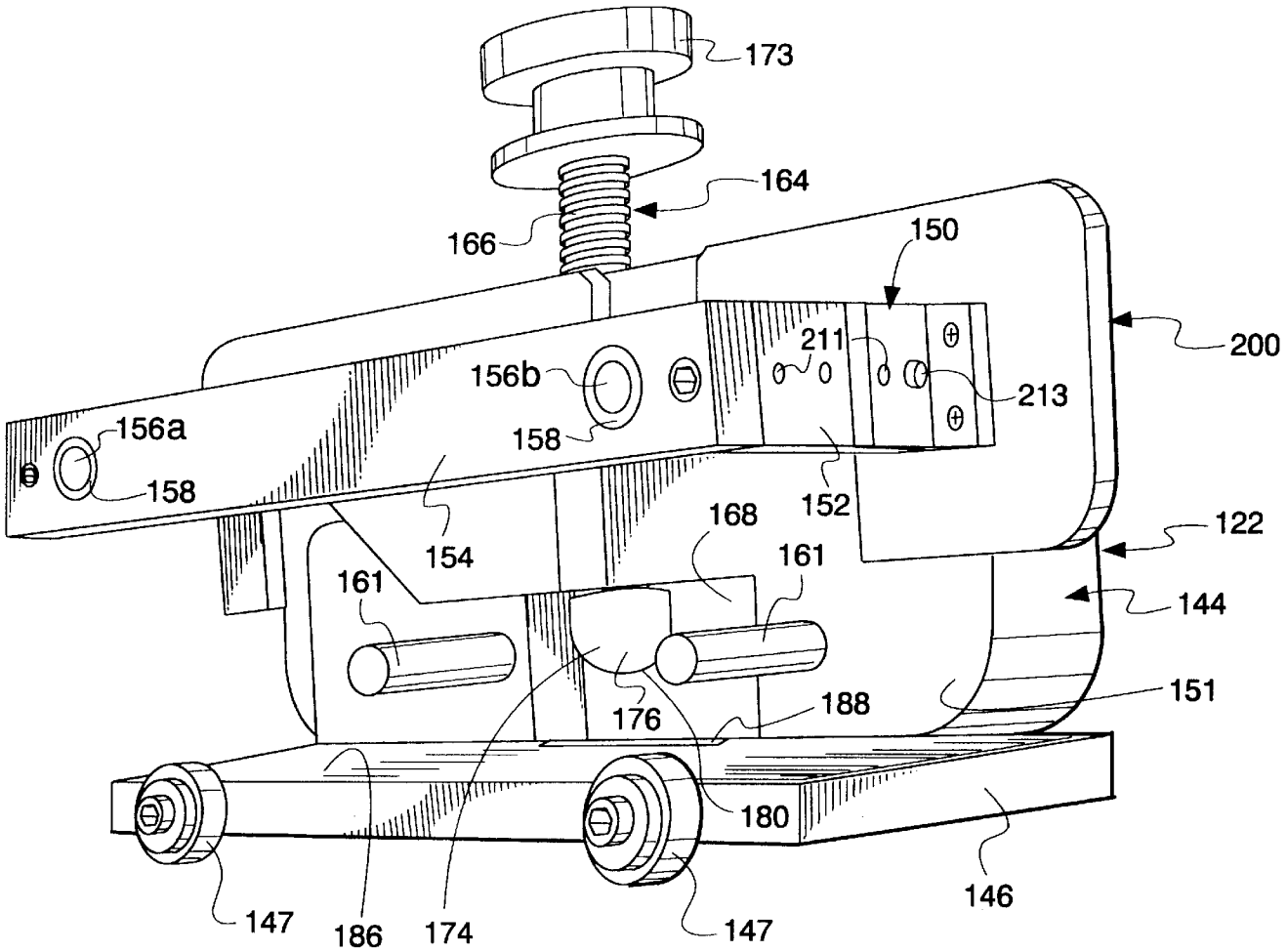
FIG. 16 is perspective view of the skiving apparatus of FIG. 9, shown with the pivotal brackets removed.

As best seen in FIGS. 11 and 16, the vertical wall 144 has a recess 168 in its front face 151 over a central, lower portion thereof in which the legs 170 of the pivotal brackets 160 are disposed, and within which the legs 170 of the pivotal brackets 160 move as the brackets 160 are pivoted about their respective pivot pins 161.

To assure that substantially equal belt clamping force is exerted on the belt by the forward and rear pairs of rollers 124*a*, 126*a* and 124*b*, 126*b* the pivotal brackets 160*a* and 160*b* are both actuated by a common, centrally disposed actuating member 164 as illustrated in FIGS. 10–12.

The actuating member 164 extends vertically through the vertical wall 144 of the carriage 122 and has a threaded shaft 166 which is threaded in a threaded bore in the vertical wall 144 and moves vertically upon manual rotation of the integral turning knob 173 of the actuating member 164. The lower end 174 of the actuating member 164 extends into the recess 168 and has a camming head 176 which is preferably of low friction plastic having a rounded bearing surface 180 which bears simultaneously against the legs 170 of both of the pivotal brackets 160 which extend into the recess 168.

Figure 15:
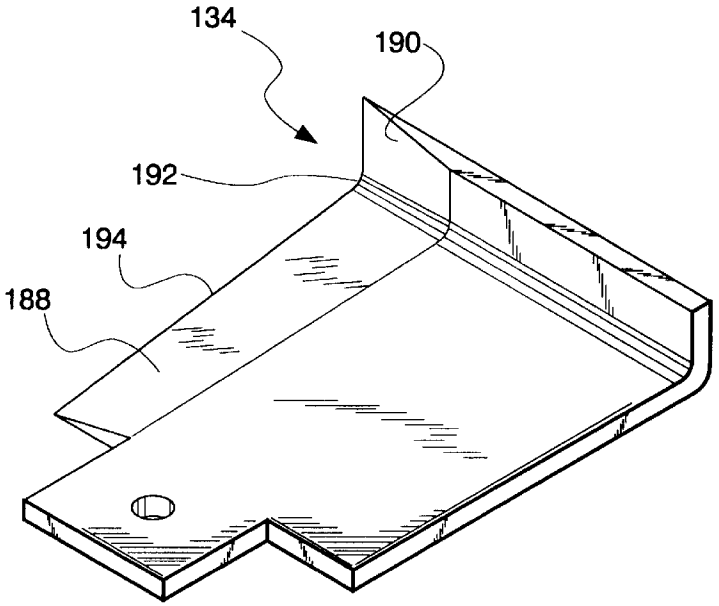
FIG. 15 is an enlarged perspective view of the blade in the skiving apparatus of FIG. 9.

Upon manual clockwise rotation of the turning knob 173, the camming head 176 is moved downwardly to simultaneously force both the legs 170 of the pivotal brackets 160 downwardly within the recess 168. The pivotal brackets 160 are simultaneously pivoted about their respective pivot pins 161 to move the pressure rollers 126*a* and 126*b* from their release position illustrated in FIG. 11 to their clamping position illustrated in FIG. 10 to clamp the belt between the pressure rollers 126*a* and 126*b* and their respective driving rollers 124*a* and 124*b*. The leading end 127 of the belt 128 may be inserted between the forward and rear, drive and pressure rollers while they are in their release position of FIG. 11. The actuating member 164 may then be screwed down until the belt 128 is securely clamped between the forward drive roller 124*b* and forward pressure roller 126*b* and the rear drive roller 124*a* and pressure roller 126*a*. The more the actuating member 164 is screwed downwardly into the vertical wall 144, the greater the clamping force exerted by the rollers 124*a*, 126*a* and 124*b*, 126*b* on the belt, with the clamping force being exerted on the belt by the front and rear pairs of rollers remaining substantially equal. The horizontal wall 146 of the carriage 122 has an aperture 189 (FIG. 16) therein beneath the recess 168, for allowing the legs 170 of the pivotal brackets 160 to move downwardly past the upper surface 186 of the horizontal wall 146. The skiving blade 134 which cuts the strip 131 from the belt 128 is preferably J-shaped, having a horizontal portion 188 adjacent the vertical wall 144 and a vertical portion 190 spaced from the vertical wall 144, which portions 188 and 190 are interconnected by an integral intermediate arcuate portion 192. The forward edge 194 of the blade 134 is preferably sharp and continuous to continually slice the strip 131 from the belt 128 as the belt is advanced past the forward edge 194 of the blade 134. The blade 134 is secured in a selective, stationary position prior to and during skiving. (See FIG. 15.)

The height of the horizontal portion 188 of the blade 134 above the horizontal wall 146 determines the thickness of the belt strip 131 being cut and thereby, the depth of the groove formed at the belt end. The height of the blade 134, and hence the height of the horizontal portion of the blade 134, is selectively variable by rotation of the knob 195 (FIG. 10) of a blade adjusting means 196.

As best seen in FIGS. 9 and 10, the blade adjusting means 196 comprises a threaded shaft 196*a* threaded in a bore 196*b* of a stationary frame plate 189 which is spaced by a space 191 from the top of a blade carrying block 192 which has its vertical slides guided for vertical sliding movement in guideways 193 in the stationary frame. The lower end of the shaft 196*a* is captured in the blade-carrying block 192 vertically as the shaft is turned to thereby move the blade up or down. The blade adjusting means 196 is threadably engaged with the vertical wall 144 of the carriage 122 for selective upward and downward movement of the blade adjusting means 196 and the blade 134 engaged thereto upon rotation of the knob 195.

The distance of the vertical portion 190 of the blade 134 from the belt end 125 determines the width of the strip 131 cut from the belt 128, i.e. the width of groove formed in the belt, adjacent the belt end 125. In the preferred and illustrated embodiment, rather than adjust the horizontal position of the blade, the position of the belt end 125 is variable to selectively vary the width of the groove formed in the belt.

Figure 17:
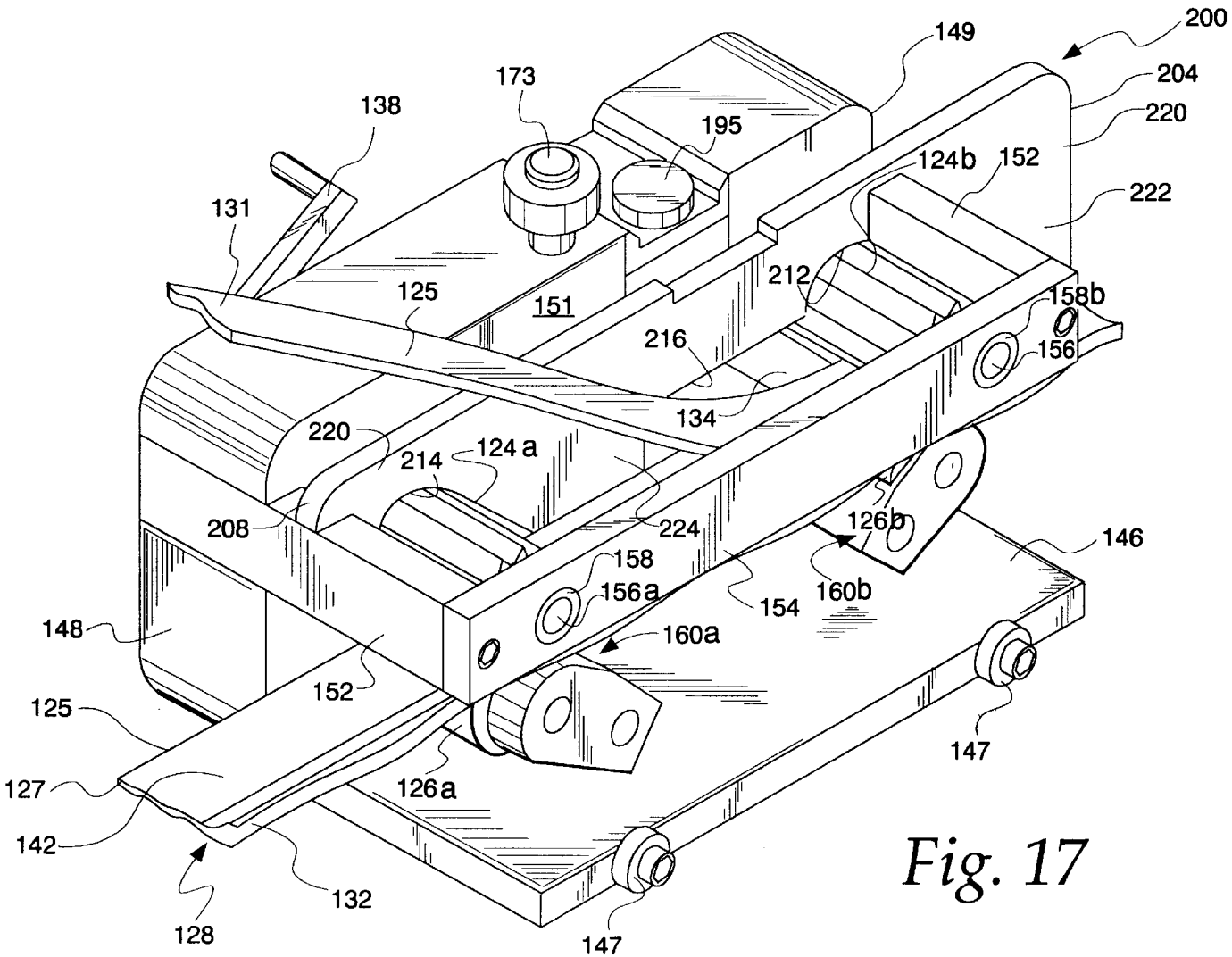
FIG. 17 is a perspective view of the skiving apparatus of FIG. 9, shown with the fence moved forward relative to the fence position of FIG. 9.

In the preferred embodiment of the invention, to allow for simple and accurate variations of the width of the strip cut from the belt end, a fence 200 (FIGS. 1 3 and 17) is provided which comprises a flat, vertical plate extending substantially parallel to the front face 151 of the vertical wall 144 of the carriage 122. The position of the fence 200 is adjustable for variation of its distance from the front face 151 of the vertical wall 144; and hence, variation of the distance of the vertical portion 190 of the blade 134 from the end 125 of the belt 128 being skived, and hence the wider the groove formed in the belt adjacent its end 125. As best seen in from a comparison of FIGS. 9 and 17, the fence 200 is spaced from the vertical wall 144 in FIG. 17 and the fence 200 is abutted against the vertical wall 144 in FIG. 9. Thus, it will be seen that the further the fence 200 is positioned from the front face 151 of the vertical wall 144 during skiving, the narrower the strip 131 cut from the belt; and, the closer the fence 200 is positioned to the front face 151 during skiving, the wider the strip 131 cut from the belt, and hence the wider the groove formed in the belt adjacent its end 125.

To allow for selective positioning of the fence 200 for a desired width of groove cut, the fence 200 is slidably supported between the spaced legs 152 of the supporting bracket 150 for sliding adjustment toward and away from the front face 151 of the vertical wall 144. As best seen in FIG. 9, the fence 200 has two vertical surfaces 201 and a horizontal surface 203 for sliding engagement with the upper portion of the forward leg 152 of the bracket 150. These surfaces 201 and 203 define a rectangular aperture 202 near its forward end 204 for receiving the rear leg 152 of the supporting bracket 150 therethrough. The fence 200 has a horizontal shoulder 206 at its rear end 208 in sliding engagement with the upper surface 210 of the rear leg 152 of the supporting bracket 150. Hence, the fence 200 is slidable along the pair of legs 152 of the supporting bracket 150 toward and away from the front face 151 of the rear wall 144. The fence 200 may be secured in a selective stationary position along the legs 152 of the support bracket 150 by providing a plurality of horizontally spaced holes 211 (FIG. 16) in the forward surface 152*a* of the forward leg 152, and providing a bracket mounted to the front face 220 of the fence 200 with the bracket having a hole at a vertical height corresponding to the vertical height of the holes in the leg 152. After the fence 200 has been slid to its desired position along the legs 152, the hole in the bracket mounted to the fence will be in registration with one of the horizontally spaced holes 211 of the forward leg 152, and a pin 213 may then be inserted through the hole of the bracket and into the corresponding hole of the leg 152 to secure the fence 200 in a stationary position along the legs 152. Manifestly, a wide variety of other engaging means may be employed for securing the fence 200 in a selective, stationary position along the legs 152.

In the illustrated embodiment, the fence 200 has forward and rear arcuate cutout portions 212 and 214 (FIG. 17) for accommodating the respective forward and rear drive rollers 124*b* and 124*a*, and a central cutout portion 216 for accommodating the blade 134. Hence, the cutout portions 212, 214 and 216 allow free forward and rearward sliding movement of the fence 200 along the legs 152 without interference of the fence 200 with the drive rollers 124*a* and 124*b* and the blade 134. The fence 200 extends from a rear end 208, which is generally coterminous with the rear end 148 of the vertical wall 144, to a forward end 204 which extends beyond the forward end 149 of the vertical wall 144, so that the fence 200 extends significantly forward of the forward driving roller 124*b*. The portion of the fence 200 which extends forward of the forward leg 152 extends downwardly to a vertical height below the drive rollers 124 to define a forward guiding surface portion 222 of the front face 220 of the fence 200.

The provision of the forward guiding surface portion 222 significantly forward of the forward driving roller 124*b* serves to provide an elongated guiding surface for guiding of the end 125 of the belt 128 prior to the belt 128 being passed into the forward nip between the forward pair of driving and pressure rollers 124*b* and 126*b* to provide accuracy in alignment of the belt 128 as it enters the forward nip between the forward pair of rollers. The fence 200 also has a rear guiding surface portion 224 which also extends downwardly to a vertical height below the drive rollers 124. During skiving, the end 125 of the belt 128 is maintained flush against both the forward and rear guiding surface portions 222 and 224 of the front face 220 of the fence 200 to maintain the end 125 of the belt substantially perpendicular to the axes of the drive rollers 124*a* and 124*b* as the belt is guided beneath the drive rollers 124*a* and 124*b* .

It is preferred to provide a means to maintain the end 125 of the belt 128 being skived flush against the front face 220 of the fence 200 throughout advancement of the carriage 122 along the width of the belt 128, and prevent migration of the belt end 125 away from the front face 220 of the fence 200 as the carriage is driven across the width of the belt. To this end, the illustrated means is in the form of spiral threads 226 (FIG. 14) on the peripheral surface of the pressure rollers 126*a* and 126*b*. The spiral threads 226 of the pressure rollers 126*a* and 126*b* draw the belt 128 in the direction of the front face 220 of the fence 200 as the belt 128 is driven between the front pair of rollers 124*b* and 126*b* and the rear pair of rollers 124*a* and 126*a*, with the pressure rollers 126*b* and 126*a* in their clamping position. By way of illustrative example, a left-handed spiral thread having a pitch of approximately 3.5 inch was found to provide good results in drawing the belt in the direction of the fence 200, and maintaining the end 125 of the belt flush against both the central and rear guiding surface portions 222 and 224 of the front face 220 of the fence 200 as the carriage 122 is advanced along the width of the belt. This provides improved accuracy in the skiving of belt ends.

The driving rollers 124*a* and 124*b* are preferably fluted about their periphery to define a plurality of longitudinally extending parallel flutes 182 and longitudinally extending elongated teeth 184 about their periphery. The elongated teeth 184 firmly grip the belt 128 for accurate driving of the carriage 122 relative to the belt without slippage of the belt between the drive rollers and pressure rollers. The drive rollers 124 may be made of aluminum or steel or plastic and the straight, parallel flutes and teeth of the driving rollers 124*a* and 124*b* allow the drive rollers to be produced by extrusion at low cost.

To carry out skiving of a belt with the skiving apparatus 120, initially the end 125 of the belt 128 to be skived is placed flush against the rear guiding surface portion 222 of the front face 220 of the fence 200 to properly align the belt end 125. With the belt end 125 maintained flush against the rear guiding surface portion 222, the carriage 122 is rolled on its wheels 147 toward the belt to bring the leading side 127 of the belt 128 into the nip between the forward driving roller 124*b* and the forward pressure roller 126*b*. The actuating member 166 is rotated clockwise to raise the forward pressure roller 126*b* to firmly clamp the belt 128 between the forward drive roller 124*b* and the forward pressure roller 126*b*. As discussed above, in the preferred embodiment, the adjustment of the height of the forward pressure roller 126*b* effects the simultaneous adjustment of the height of the rear pressure roller 126*a*. With the leading end 127 of the belt 128 engaged by the forward drive roller 124*b* and pressure roller 126*b*, the crank arm 138 may be rotated to simultaneously rotate the front and rear drive rollers 124*b* and 124*a*. The rotation of the forward drive roller 124*b* advances the carriage 122 toward the trailing side 129 of the belt 128, with the blade 134 slicing a strip 131 from the belt 128 adjacent its end 125 as the carriage 121 to which the blade is mounted is advanced relative to the belt.

The forward pair of rollers 124*b* and 126*b* advance the carriage 122 relative to the belt 128, to move the leading side 127 of the belt 128 past the cutting blade 134 to the rear pair of driving and pressure rollers 124*a* and 126*a*. Thereat, the leading side 127 of the belt 128 passes into the nip between the rear pair of rollers 124*a* and 126*a*, at which point the belt is driven by both the forward pair of rollers 124*b* and 126*b* and the rear pairs of rollers 124*a* and 126*a*. The end 125 of the belt 128 is maintained flush against the front face 220 of the fence 200 throughout the skiving operation. Both the forward and rear pairs of rollers advance the carriage with respect to the belt to slide off a strip from the belt adjacent its upper surface, until the trailing end of the belt passes through the forward pair of rollers. After the trailing side 129 of the belt 128 passes out of engagement with the forward pair of rollers 124*b* and 126*b*, the belt still remains firmly gripped by the rear pair of rollers 124*a* and 126*a* which continue to advance the carriage 122 and the blade 134 mounted thereto relative to the belt 128, to advance the trailing side 129 of the belt past the blade 134 to cut the strip 131 completely to the trailing side 129 of the belt 128. That is, after the trailing side 129 of the belt 128 passes out of engagement with the forward drive roller 124*b* and pressure roller 126*b*, there remains a small uncut portion of the strip 131 adjacent the trailing side 129 of the belt due to the gap between the forward or leading edge 194 of the blade 134 and the forward drive roller 124*b*. That is, near the end of a skiving operation, the trailing side 129 of the belt 128 passes through the forward pair of rollers 124*b* and 126*b*, and out of engagement with the forward driving roller 124*b*, whereafter the forward driving roller 124*b* no longer advances the belt relative to the carriage 122.

Hence, in the skiving apparatus 20 discussed above, having only one pair of rollers 24 and 26 which pair of rollers are disposed forward of the blade 34, once the trailing side of the belt 28 passes through the rollers 24 and 26 and out of engagement with the rollers, there is no longer any force driving the belt forward relative to the blade 34. To overcome this problem, the additional, rear pair of rollers 124*a* and 126*a* in the preferred embodiment skiving apparatus 120 which define a rear nip rearward of the blade 134 remain clamped about the belt 128 continue to drive the carriage 122 relative to the belt 128 after the trailing side 129 of the belt has passed through the forward pair of rollers 124*b* and 126*b* to drive the trailing side 129 of the belt 128 past the blade 134. Hence, the provision of an additional rear nip rearward of the blade 134 allows the tool to finish off the cut at the trailing side 129 of the belt 128 and eliminates the problem of a small uncut portion remaining at the trailing side 129 of the belt 128.

Figure 21:
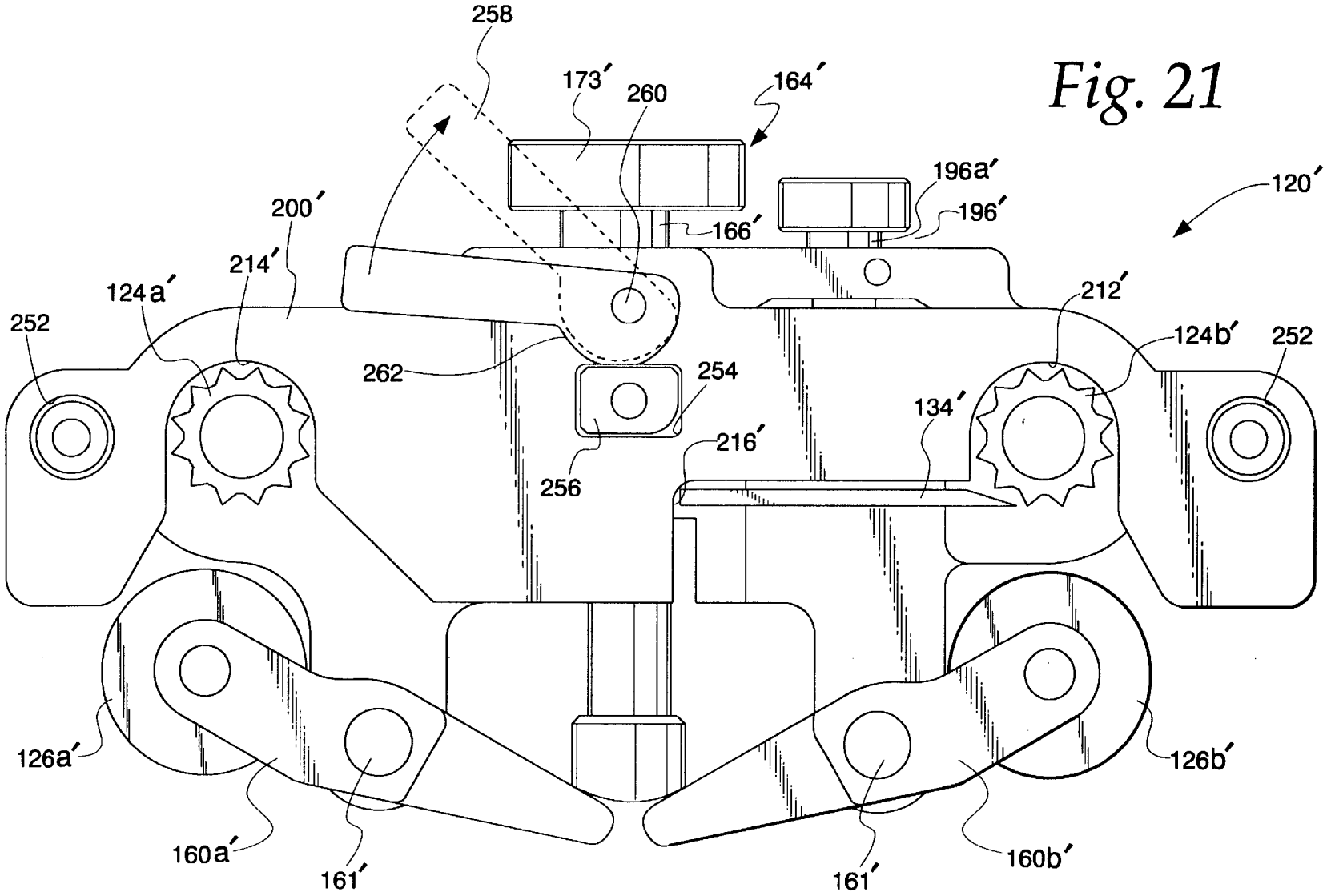
FIG. 21 is a front elevational view of the skiving apparatus of FIG. 20.
Figure 22:
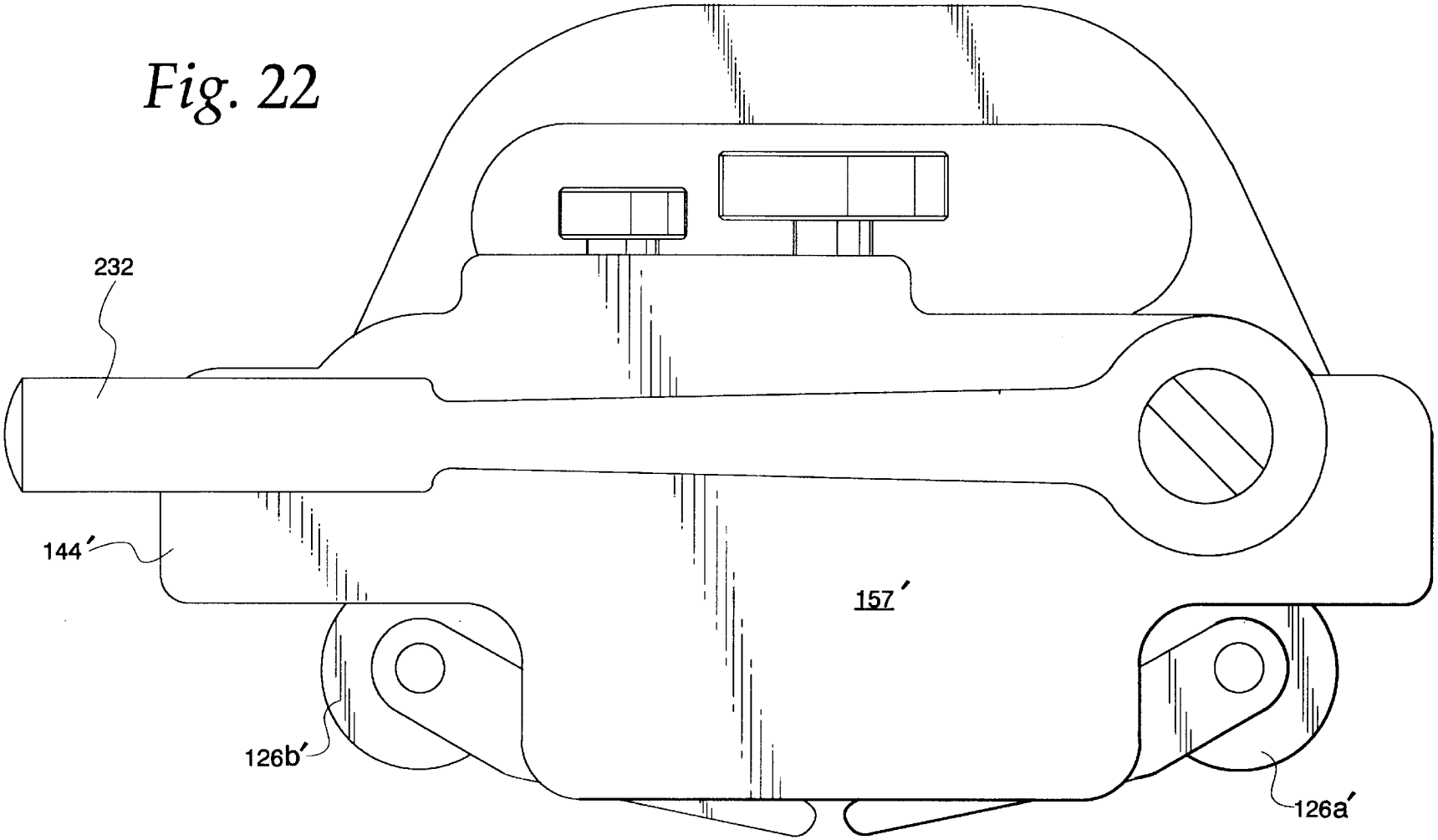
FIG. 22 is a rear elevational view of the skiving apparatus of FIG. 20.
Figure 23:
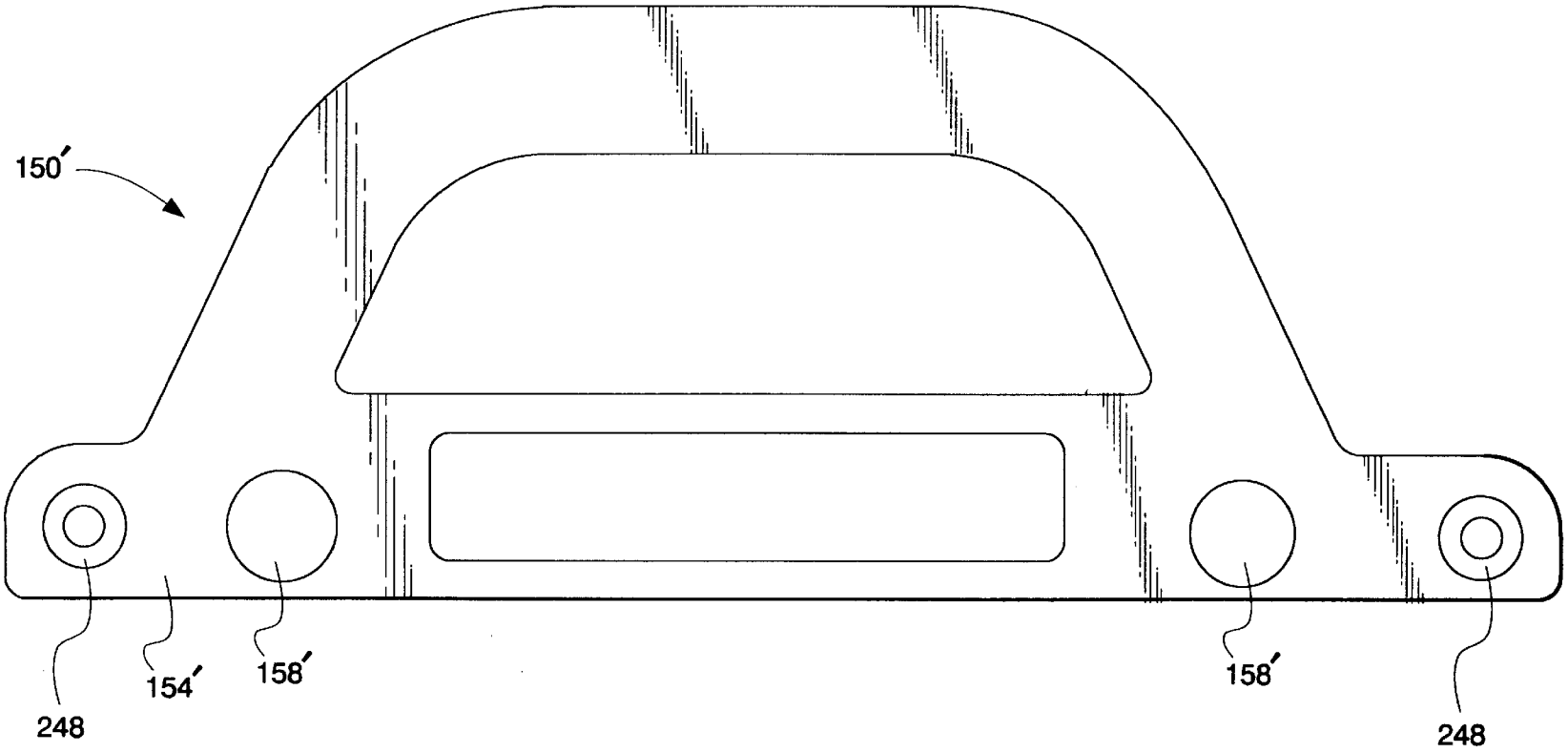
FIG. 23 is an enlarged elevational view showing the handle of the skiving apparatus of FIGS. 20-22.

A slightly modified version of the skiving apparatus 120 is illustrated in FIGS. 20–23. The following description of FIGS. 20–23 utilizes prime reference numerals for parts similar to those used with skiving apparatus 120. The slightly modified skiving apparatus 120' is best seen in FIG. 21. Similar to the skiving apparatus 120', there is a vertical wall 144'; however, the horizontal wall 146 and wheels 147 in skiving apparatus 120 have been removed from the skiving apparatus 120'.

In skiving apparatus 120', the portion of the belt 128 adjacent its end 125 is passed through a pair of nips defined by respective pairs of rear and forward driving and pressure rollers 124*a'* and 126*a'*, and 124*b'* and 126*b'*, with their operation substantially the same as in skiving apparatus 120 and therefore, will be described only to the extent necessary for an understanding of the basic operation of skiving apparatus 120' and the modifications made to skiving apparatus 120. As before, the forward nip is defined by the forward driving and pressure rollers 124*b* ' and 126*b'* disposed closely ahead of the blade 134' so that the belt 128 has an upper strip 131 sliced therefrom. By providing the rear driving roller 124*a* ' and rear pressure roller 126*a'*, the belt 128 continues to be pulled so that its trailing end 129 engages the blade 134' to ensure a complete cut of the strip 131 near the trailing side 129 thereof.

The driving rollers 124*a'* and 124*b'* are interconnected by a chain. The rear drive roller 124*a'* is rotated through a ratchet arm 232 attached to the rear drive roller 124*a'* so that alternate cranking and ratcheting of the ratchet arm 232 causes both of the forward and rear pair of rollers to advance the cutting blade 134' relative to the belt 128.

In the skiving apparatus 120', a bracket 150' is provided for supporting the rear and forward driving rollers 124*a'* and 124*b* ' for rotation about their fixed rotational axes. The rear drive roller 124*a'* has an elongated axle 156*a'* which extends through the vertical wall 144', with the portion extending through the vertical wall having a hex nut 230 mounted thereto as by a pin 231. A similar elongated axle 156*b'* and hex nut 230 can be associated with the forward drive roller 124*b'*. At the other end of the rear and forward drive rollers 124*a'* and 124*b'*, the axles 156*a'* and 156*b*, are each formed into stub axles which are received in bearings 158' of a roller engaging bar portion 154' of the support bracket 150'.

The vertical wall 144' has a recess 159' milled therein from the bottom surface thereof. The recess 159' contains therein the sprocket wheels 162' and hubs thereof which are mounted on the elongated axle 156*a'* and 156*b'*. By milling the recess 159' from the bottom surface of the vertical wall 144', the sprocket wheels 162' and chain are protected, particularly by the end face 157' of the vertical wall 144'.

Similar to the skiving apparatus 120, the pressure rollers 126*a'* and 126*b'* are mounted for rotation on pivotal brackets 160', which are, in turn, mounted on respective pivot pins 161' extending horizontally forward from the vertical wall 144'. By use of actuating member 164' the belt clamping force can be simultaneously equally adjusted on the pairs of rollers 124*a* ', 126*a'*, and 124*b* ', 126*b'*. As in the skiving apparatus 120, the actuating member 164' has a threaded shaft 166' which moves vertically through the wall 144' upon manual rotation of integral turning knob 173' of the actuating member 164'.

To adjust the vertical blade height and therefore the thickness of the belt strip 131 that will be cut, a blade adjusting means 196' is provided. Similar to blade adjusting means 196, blade adjusting means 196' includes a threaded shaft 196*a'* which extends into engagement with a blade carrying block for movement of the blade 134' in the vertical direction.

To adjust the width of the strip cut from the belt end, skiving apparatus 120' includes an adjustable fence 200' which is supported for movement to and from vertical wall 144'. The vertical wall 144' includes apertures 144*a'* adjacent its rear and forward ends 148' and 149' for receipt of ends of guide legs 152' as by a friction fit therein. At the other end of the guide legs 152', the guide legs 152' are secured in apertures of the roller engaging bar portion 154'. In the forward surface of the roller engaging bar portion 154', countersunk recesses 248 are provided so that set screws 250 can be inserted therein to be threadably received in the guide legs 152'. Thus, the support bracket 150' is formed by the roller engaging bar portion 154' and the guide legs The fence 200' is slidably supported on the guide legs 152' which extend through corresponding apertures 252 therein. The fence 200' also has a central aperture 254. The central aperture 254 is adapted to receive a guide rod 256 extending horizontally from the vertical wall 144'. The fence 200' includes rear and forward arcuate cutout portions 212' and 214' for accommodating the respective rear and forward drive rollers 124*a* and 124*b* and an intermediate cutout portion 216' for accommodating the blade 134'. The cutout portions 212', 214', and 216' allow free forward and rearward sliding movement of the fence 200' along the guide legs 152' and the guide rod 256.

For selective positioning of the fence 200' for a specific desired width of a belt cut, the fence 200' includes a centrally disposed cam lever 258 associated therewith, as best seen in FIG. 21. The cam lever 258 is pivotably attached to the fence 200' by pin 260 so that the cam lever 258 can be pivoted between a locked position and a release position. In the locked position, as shown in solid lines in FIG. 21, the cam lever 258 is in a horizontal position such that cam surface 262 thereof tightly engages a top surface 264 of the guide rod 256 to prevent the fence 200' from translating along the guide legs 152' and guide rod 256. To facilitate the locking action between the cam surface 262 and the top surface 264, the top surface can be provided with a series of notches (not shown) therein for receipt of the cam surface 262. To release the fence 200' for sliding movement towards and away from the vertical wall 144', the cam lever 258 is pivoted clockwise to a release position, as seen in dashed lines in FIG. 21, wherein the cam surface 262 is pivoted out of engagement with the top surface 264 of the guide rod 256, thereby allowing free translation of the fence 200' along the guide legs 152' and central guide rod 256. The guide rod 256 can be provided with indicia along its length on the top surface 264 thereof, for example alongside each notch, to provide an indication of the exact width of the belt being cut.

The foregoing disclosure of specific embodiments is intended to be illustrative of the broad concepts of the invention described herein.

What is claimed is:

1. An apparatus for skiving a conveyor belt having upper and lower faces with a belt thickness therebetween with operation of the skiving apparatus removing a narrow transverse strip having a predetermnined width from the upper face of the conveyor belt at a transverse end portion thereof from a first, leading side of the belt end portion to a second, trailing side of the belt end portion, the apparatus comprising:

a carriage for traveling across the belt end portion in a transverse direction;

a belt cutting blade mounted on said carriage, said belt cutting blade having a forward cutting edge for cutting away the narrow transverse strip from the upper face of the conveyor belt at the belt end portion;

first drive means on the carriage forming a first nip forward of said belt cutting blade to clamp on both faces of the belt at the belt end portion and for driving the carriage in the transverse direction across and along the belt end portion from said leading side of the belt toward said traiing side of the belt end portion, with the belt cutting blade cutting the belt end portion during said driving of the carriage relative to the belt, with the belt end portion passing out of engagement with the first drive means upon the trailing side of the belt end portion passing through said first nip which leaves a small uncut portion of the narrow transverse strip adjacent the trailing side of the belt end portion; and second drive means on the carriage forming a second nip rearward of said belt cutting blade for continuing said driving of the carriage in the transverse direction across and along the belt end portion subsequent to said trailing side of the belt end portion passing through said first nip, to drive the forward cutting edge of the cutting blade past said trailing side of the belt end portion to cut said small uncut portion remaining adjacent the trailing side of the belt end portion.

2. A conveyor belt skiving apparatus in accordance with claim 1 in which the first drive means and second drive means comprise first and second pairs of rollers, respectively, between which the conveyor belt end portion is received, with the first and second pairs of rollers movable into engagement with the upper and lower faces of the belt at the belt end portion to clamp the belt end portion between the first and second pairs of rollers.

3. A conveyor belt skiving apparatus in accordance with claim 2 in which one of the pairs of rollers includes a drive roller having a drive axle portion extending through the carriage distal from the blade with a nut mounted on the drive axle portion, and a ratchet arm having a socket configured to receive the nut therein wherein operation of the ratchet arm drives the drive axle portion through the socket and nut to rotate the drive roller.

4. A conveyor belt skiving apparatus in accordance with claim 3, wherein the ratchet arm is one of (1) a pneumatically powered ratchet arm, and (2) a manually cranked ratchet arm.

5. A conveyor belt skiving apparatus in accordance with claim 2 in which the carriage further comprises a fence defining a flat guiding surface for guiding the belt to maintain proper alignment of the belt with respect to the carriage.

6. A conveyor belt skiving apparatus in accordance with claim 5 in which at least one of said first and second first and second pairs of rollers has means for biasing the belt toward the fence upon advancement of the belt relative to the rollers.

7. A conveyor belt skiving apparatus in accordance with claim 6 in which the means for biasing the belt toward the fence comprises spiralled threads on the at least one of said first and second rollers.

8. A conveyor belt skiving apparatus in accordance with claim 5 in which the fence is repositionable in a direction normal to the transverse driving direction of the carriage for selective variability of the predetermined width of the transverse strip cut from the belt end portion.

9. A conveyor belt skiving apparatus in accordance with claim 8 in which the blade includes a vertical portion to cut vertically and a horizontal portion to cut horizontally and further including means for selectively adjusting the horizontal portion of the blade in a vertical direction for selective variation of the thickness of the transverse strip cut from the belt at the belt end portion.

10. A conveyor belt skiving apparatus in accordance with claim 1 in which the blade includes a vertical portion to cut vertically and a horizontal portion to cut horizontally and further including a fence defining a flat guiding surface for guiding the belt to maintain proper alignment of the belt relative to the carriage, the fence being repositionable toward and away from the vertical portion of the belt cutting blade for selective variation of the predetermined width of the transverse strip cut from the belt end portion.

11. A conveyor belt skiving apparatus in accordance with claim 10 including a cam means for locking the guiding surface in a plurality of different positions relative to the vertical portion of the belt cutting blade.

12. A conveyor belt skiving apparatus in accordance with claim 1 in which said cutting blade is generally J-shaped and defines a horizontal blade portion and a vertical blade portion.

13. A small free standing apparatus for easy portability to allow the apparatus to be easily moved to a conveyor belt location for skiving a conveyor belt having upper and lower faces with a belt thickness therebetween with operation of the skiving apparatus removing a narrow transverse strip having a predetermined width from the upper face of the conveyor belt adjacent an end portion of the belt to form a transverse groove in the belt end portion, the apparatus comprising:

a carriage for traveling across the belt end portion in a transverse direction;

a carrying handle mounted to the carriage to allow the carriage to be easily lifted and moved from one conveyor belt location to another belt location for operation of the skiving apparatus thereat;

a belt cutting blade mounted on said carriage in a fixed and stationary position thereon during a cutting operation with the blade having a rigid cutting edge for cutting away the narrow transverse strip from the upper face of the conveyor belt at the belt end portion;

a drive on the carriage forming a nip to clamp on both faces of the belt at the belt end portion and for driving the carriage transversely across the belt end portion to force the fixed and stationary cutting blade against the belt end portion with sufficient force to allow the blade rigid cutting edge to cut the transverse strip from the belt end portion thereby skiving the belt; and an adjustable guiding surface on the carriage for engaging and guiding an end edge of the end portion of the belt to maintain proper alignment of the belt with respect to the carriage during the skiving operation and being selectively adjustable in a direction for selective variability of the predetermined width of the transverse strip cut from the belt.

14. A conveyor belt skiving apparatus in accordance with claim 13 in which said cutting blade is a generally J-shaped blade having a horizontal blade portion and a vertical blade portion, and said cutting blade is vertically repositionable for selective variability of the thickness of the transverse strip cut from the belt end portion.

15. A conveyor belt skiving apparatus in accordance with claim 13 in which the drive includes a pair of rollers between which the conveyor belt is received, with the rollers movable into engagement with the upper and lower faces of the belt to clamp the belt end portion between the pairs of rollers.

16. A conveyor belt skiving apparatus in accordance with claim 15 wherein one of the rollers includes a drive axle portion with a polygonal nut mounted on the drive axle portion distal from the blade, and a ratchet arm having a socket configured to receive the polygonal nut therein wherein operation of the ratchet arm drives the drive axle portion through the socket and nut to rotate the one roller.

17. A conveyor belt skiving apparatus in accordance with claim 13 including a cam means for locking the adjustable guiding surface in a plurality of different positions relative to the carriage for selective variability of the predetermined width of the transverse strip cut from the belt end portion.

18. A conveyor belt skiving apparatus in accordance with claim 17 wherein the cam means includes a lever associated with the guiding surface and a guide rod on which the guiding surface translates to the plurality of different positions with the lever having a cam surface thereon cooperating with the guide rod, the lever having a locked position wherein the guiding surface is fixed relative to the carriage in one of the plurality of different positions and a release position wherein the guiding surface can translate on the guide rod to another one of the plurality of different positions.

* * * * *

UNITED STATES PATENT AND TRADEMARK OFFICE

CERTIFICATE OF CORRECTION

PATENT NO. : 5,771,586

DATED : June 30, 1998

INVENTOR(S) : Lotarski, et al.

It is certified that error appears in the above-indentified patent and that said Letters Patent is hereby corrected as shown below:

Column 17, line 49, change "traiing" to --trailing--.

Signed and Sealed this

Twenty-second Day of September, 1998

*Attest:*

Bruce Lehman

BRUCE LEHMAN

*Attesting Officer*

*Commissioner of Patents and Trademarks*